US006051770A

United States Patent [19]

Milburn et al.

[11] Patent Number: 6,051,770

[45] Date of Patent: Apr. 18, 2000

[54] METHOD AND APPARATUS FOR COMPOSING ORIGINAL MUSICAL WORKS

[75] Inventors: Andy M. Milburn; Jay Hardesty; Joseph P. Lubin, all of New York, N.Y.

[73] Assignee: Postmusic, LLC, New York, N.Y.

[21] Appl. No.: 09/026,024

[22] Filed: Feb. 19, 1998

[51] Int. Cl.[7] ..... G10H 1/02; G10H 1/12; G10H 1/20; G10H 1/40

[52] U.S. Cl. ..... 84/611; 84/619; 84/622; 84/627; 84/635; 84/DIG. 9; 84/DIG. 12

[58] Field of Search ..... 84/609–614, 622–625, 84/634–638, DIG. 12, DIG. 22, 619, 627, DIG. 9, 649–652, 657, 663, 666–669

[56] References Cited

U.S. PATENT DOCUMENTS

| | | | |
|---|---|---|---|
| 4,926,737 | 5/1990 | Minamitaka | 84/611 |
| 5,375,501 | 12/1994 | Okuda | 84/611 |
| 5,486,646 | 1/1996 | Yamashita et al. | 84/635 |
| 5,548,080 | 8/1996 | Minamitaka et al. | 84/627 |
| 5,621,182 | 4/1997 | Matsumoto | 84/610 |
| 5,627,335 | 5/1997 | Rigopulos et al. | 84/635 |
| 5,705,761 | 1/1998 | Minamitaka | 84/609 |
| 5,736,666 | 4/1998 | Goodman et al. | 84/637 X |
| 5,753,843 | 5/1998 | Fay | 84/609 |
| 5,834,670 | 11/1998 | Yumura et al. | 84/610 |

FOREIGN PATENT DOCUMENTS 0 143 578 6/1985 European Pat. Off. .

OTHER PUBLICATIONS

Cope, David, *Experiments in Musical Intelligence*, vol. 12, 1996, Chapter 1 (pp. 1–52) and Chapter 3 (pp. 79–121).

*Primary Examiner*—Stanley J. Witkowski
*Attorney, Agent, or Firm*—Fenwick & West LLP

[57] ABSTRACT

A system and method for creating and composing musical works by selecting existing musical elements and applying modification modules to them. Existing musical selections reside in a database as metrics, or targets for the composition of new pieces. The present invention composes a new piece of music by, for example, specifying component musical features in the selected targets that should be modified or retained in creating the new work. Such musical features include, for example, rhythmic characteristics, harmonic characteristics, and the like. In this manner, a user who is, musically untutored is able to create satisfying, original works having desired characteristics as specified by the user.

33 Claims, 14 Drawing Sheets

| | | C | G | D | A | E | B | F# | C# | G# | E♭ | B♭ | F |
|---|---|---|---|---|---|---|---|---|---|---|---|---|---|
| 1021 | G | 1 | 1 | 1 | 1 | 1 | 0 | 0 | 0 | 0 | 0 | 1 | 1 |
| | sum | 1 | 1 | 1 | 1 | 1 | 0 | 0 | 0 | 0 | 0 | 1 | 1 |
| | norm. | 1 | 1 | 1 | 1 | 1 | 0 | 0 | 0 | 0 | 0 | 1 | 1 |
| 1022 | A | 1 | 1 | 1 | 1 | 1 | 1 | 1 | 0 | 0 | 0 | 0 | 0 |
| | C | 1 | 1 | 1 | 1 | 0 | 0 | 0 | 0 | 0 | 1 | 1 | 1 |
| | sum | 2 | 2 | 2 | 2 | 1 | 1 | 1 | 0 | 0 | 1 | 1 | 1 |
| | norm | 1 | 1 | 1 | 1 | 0.5 | 0.5 | 0.5 | 0 | 0 | 0.5 | 0.5 | 0.5 |
| 1023 | D | 1 | 1 | 1 | 1 | 1 | 1 | 0 | 0 | 0 | 0 | 0 | 1 |
| | B | 0 | 0 | 1 | 1 | 1 | 1 | 1 | 1 | 1 | 0 | 0 | 0 |
| | G | 1 | 1 | 1 | 1 | 1 | 0 | 0 | 0 | 0 | 0 | 1 | 1 |
| | sum | 2 | 2 | 3 | 3 | 3 | 2 | 1 | 1 | 1 | 0 | 1 | 2 |
| | norm | 0.66 | 0.66 | 1 | 1 | 1 | 0.66 | 0.33 | 0.33 | 0.33 | 0 | 0.33 | 0.66 |
| 1024 | C# | 0 | 0 | 0 | 0 | 1 | 1 | 1 | 1 | 1 | 1 | 1 | 0 |
| | B♭ | 1 | 1 | 0 | 0 | 0 | 0 | 0 | 1 | 1 | 1 | 1 | 1 |
| | D | 1 | 1 | 1 | 1 | 1 | 1 | 0 | 0 | 0 | 0 | 0 | 1 |
| | B | 0 | 0 | 1 | 1 | 1 | 1 | 1 | 1 | 1 | 0 | 0 | 0 |
| | G | 1 | 1 | 1 | 1 | 1 | 0 | 0 | 0 | 0 | 0 | 1 | 1 |
| | sum | 3 | 3 | 3 | 3 | 4 | 3 | 2 | 3 | 3 | 2 | 3 | 3 |
| | norm | 0.6 | 0.6 | 0.6 | 0.6 | 0.8 | 0.6 | 0.4 | 0.6 | 0.6 | 0.4 | 0.6 | 0.6 |

METHOD AND APPARATUS FOR COMPOSING ORIGINAL MUSICAL WORKS

FIELD OF THE INVENTION

The present invention relates to computer-based music composition tools, and in particular to computer-based music composition tool, that assist in the creation and composition of musical works.

BACKGROUND OF THE INVENTION

Music is a universal metaphorical language capable of communicating moods, emotions and other artistic sentiments to listeners. Heretofore it has been impossible to use the immediate reaction of a listener to aid the music composition process. Instead, in order to understand the elements of a musical selection that are capable of evoking emotional reactions in a listener, a person interested in composing music would have to have talent or genius, or learn music theory, a complex and lengthy endeavor.

Prior art computer-based music composition tools that attempt to assist the composition process have generally suffered from this limitation, i.e., they require a user to have talent or a substantial knowledge of music theory, and therefore are of limited use to those interested in composing music but who have neither the skill, time nor inclination to study music theory.

These prior art devices fall into the following categories, and exhibit the described limitations.

Sequencers

Musical Instrument Digital Interface (MIDI) sequencers such as Vision from Opcode Inc., Cubase from Steinberg, or Logic from Emagic, facilitate recording musical elements in digital form, and combining them into musical passages and entire pieces. However, such sequencers are limited in that the user is required to fully specify all musical parameters such as rhythm, harmony, melody, and orchestration without any help from the program.

Computer Aided Composition

Programs for algorithmic composition such as Symbolic Composer from Tonality Systems, Common Music Mode from H. Taube, Mode from Stephen Travis Pope, and DMix from IBM Corporation, contain routines for the production of musical elements using, for example, logic, mathematical formulas, grammars, probabilities, and artificial intelligence (Al) techniques like neural networks. These programs may not require a complete specification of all musical parameters, but still require the user to possess, a knowledge of music theory and also often require computer programming skills.

DMix, from IBM Corporation, allows composers to create a set of "what if" musical sketches, and the equivalent of "macros" to accelerate their compositional process. DMix produces erudite, mathematical-sounding music, and the tools can be difficult to control.

EMI, or Experiments in Musical Intelligence, developed by Dr. David Cope, scans pieces of works by famous composers and is then able to create imitations of their work. EMI has been used to create compositions in the styles of Bach, Beethoven, Chopin, Rachmaninoff, Mozart, and Stravinsky. The approach of EMI is rule-based and uses pattern-recognition algorithms. This tends to create music which sounds stiff and often nonsensical, with oddly-formed melodies and harmonies. In order to achieve acceptable results, one must have detailed knowledge of musical theory.

U.S. Pat. No. 5,663,517, issued Sep. 2, 1997 to D. V. Oppenheim, for "Interactive System for Compositional Morphing of Music in Real-Time", describes a technique of musical morphing to generate a mutation from one musical piece to another. Oppenheim is limited to a system that identifies paired sets of elements from each of a first and second musical sequence, grouping the paired sets, and assigning morphing and transformation factors to generate a parameter for a new event. Thus, the technique of Oppenheim is relatively limited and inflexible, as it can only generate "morphs" that result from identified paired sets of elements.

Music Authoring Programs

A third group of programs such as Blue Ribbon from Microsoft, and Band-in-a-Box from PG Music, can create music based on non-technical requirements supplied by a musically naive user, but the output of these programs tends to sound mechanical and lack musical depth.

Band-in-a-Box merely offers a finite number of riffs, and tends to produce music which is repetitive. The program generates accompaniments, harmonies, and solos in a variety of styles, once the user has entered specific chords. Thus, the user must have a good understanding of music, and enter the chords him- or herself.

Koan Pro 2, from SSEYO, allows a user to input data representing a musical theme, and repeats the input, slowly changing it over time. Output music is generated from a series of rules which make the program very difficult to control. The results tend to be mechanical sounding. Moreover, this product requires the user to have compositional skill in balancing the rules and parameters needed to create music.

Song Construction Kit, from The Sound Factory, lets users build songs by pasting and mixing fragments of digital audio. Users can select from several musical styles such as rock, rap, grunge, dance, blues, country, funk, and generic pop. However, the implementation is limited, and it is extremely difficult to create any kind of chord progression.

Some programs which enable non-musicians to create original musical works, such as the Microsoft® Music Producer from Microsoft Corporation, rely on non-musical adjectives to describe various aspects of the music. For instance, the user might use terms like "happy," "aggressive," "hypnotic," or "perky" to describe harmonic and rhythmic elements. But using adjectives to determine musical elements lead, toward simplistic-sounding music, since what often gives music a particular character is the combination of elements which may or may not share the characteristics of the overall piece. A particular harmonic combination of some "happy" bass line and some "optimistic" piano part might add up to a bitter-sweet musical surface. A slow, heavy drum part might actually sound more aggressive in certain contexts than a fast aggressively-played drum part. Finding adjectives to describe these indirect modes of expression is often impractical or even impossible.

What is needed is a music composition tool which is usable by a musically untutored user in creating original musical works, and which overcomes the above-stated limitations of the prior art.

SUMMARY OF THE INVENTION

In one embodiment, the present invention comprises the following elements: a computer database for storing sample musical selections to be used in composing music; a graphical user interface (GUI) for displaying available musical selections to be used in composing music, for displaying compositional strategies, and for displaying the immediate results of the compositional process as the user composes music; input/output devices for receiving commands from a user, for auditioning sample musical selections available for use in composing music, and for playing back the music composition work-in-progress as it is composed by the user; and a computer-based music composition engine for performing various operations to automate and significantly simplify the music composition process.

The computer database stores hundreds of musical selections that may be used as starting points by a user composing music. The graphical user interface displays: available music selections for use in composing music, catalogued according to musical genres and musical characteristics; music composition strategies available to a user; and the intermediate results of the music composition process in a flowchart or node/tree format. The graphical user interface is simple to use and operates on the assumption that the user has no knowledge of music terminology that would traditionally be used to describe, analyze or categorize a piece of music. The input/output devices, including a computer keyboard and music playback facilities, permit the user to audition a music selection, and to catalogue the music selection for later use if it appears to be a promising starting point. One embodiment of the invention also has automated search and substitution facilities that automatically search the music database for suitable musical selections to substitute for other musical selections thereby greatly simplifying the compositional process.

The present invention employs existing musical selections which have been pre-recorded and which reside in the musical database as metrics, or targets for the composition of new pieces. The present invention provides a method and apparatus for enabling a user to compose a new piece of music by, for example, specifying that the resultant piece should sound like selection "A," but have harmonic characteristics of selection "B," and rhythmic characteristics of selection "C." The compositional task would not literally be performed as, in this example, by making reference to harmonic characteristics or rhythmic characteristics; rather, the musically untutored user may just desire these particular characteristics from familiarity with the music selections, without having to describe these characteristics in the terminology of music theory.

In a preferred embodiment, the interface of the present invention operates in an object-oriented fashion to encapsulate complex musical design elements within simple graphical representations, and to allow the user to hide or reveal as much information as desired concerning the structure of a particular musical composition. The encapsulation of complex musical design elements is accomplished through a framework comprised of agendas, nodes, and virtual zones.

Agendas are high-level elements that are used to encapsulate the processes used to create a passage of music, and ordinarily contain a list of nodes. Nodes are functional elements that generate a result list of notes (note list) by operating on one or more source nodes. Nodes are linked together in a web of source connections. A virtual zone is a type of node used to introduce musical material into an agenda. Each virtual zone gets a list of potential zones from the environment.

Virtual zones act as placeholders in configurations of agendas within the program. All nodes which ultimately reach back to a particular virtual zone as a source will have their outputs changed whenever the virtual zone is set to reference a different zone. This allows one configuration of agendas and nodes to create many different results without changing the configuration itself.

Different types of nodes use different algorithms for generating their results. A preferred embodiment of the present invention includes nodes that are capable of altering the rhythmic or harmonic characteristics of a music composition work-in-progress to more closely resemble the musical characteristics of a target music selection.

Another feature of the present invention automates the fragmentation of a selected complex musical selection into a series of distinct parts. This feature catalogues each of the parts comprising the complex musical fragments so that various musical operations including, for example, substitution of other music in place of a constituent part can be accomplished. Selection of suitable music selections for substitution is automated by a type of virtual zone called a shark which is used to find pairs of excerpts in the database which are close enough in role and rhythmic structure to be good candidates to substitute for each other in certain settings. Sharks augment the filtering of potential zones occurring in virtual zones by comparing the rhythms of potential parts to the rhythm of a chosen target zone.

DETAILED DESCRIPTION OF THE PREFERRED EMBODIMENT

Definitions

Figure 1:
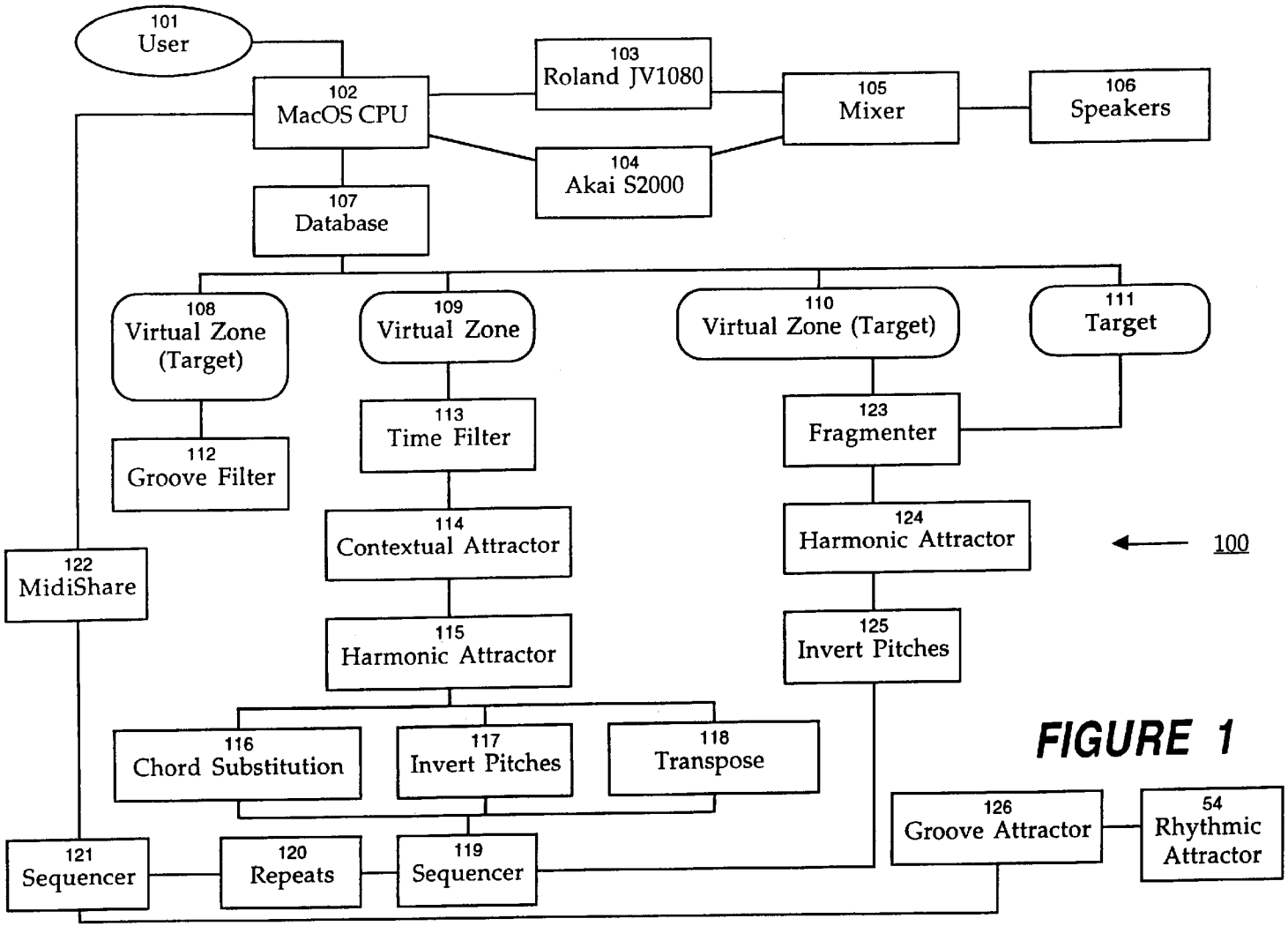
FIG. 1 is a block diagram showing overall architecture of an embodiment of the present invention.

Prior to describing operation of the present invention, a number of concepts relating to the invention will be explained.

Notes: The smallest musical unit referenced in the system is the note. A note has certain defined characteristics, such as pitch, attack, and duration. Generally, notes are not individually manipulated by the user. Rather, operations in the system are typically performed on groups of notes called parts.

Parts: A part represents a musical passage. Parts vary greatly in length, and may represent, for example, hundreds of bars of a completed piece, or merely a fragmentary passage from a single instrument. Each part is capable of outputting a list of notes (note list) representing the musical passage associated with the part. Several specialized types of parts are defined, each of which performs a particular role. Parts can be elements, nodes, or agendas. As will be described below, elements are static note lists, while nodes and agendas contain note lists that are dynamic and are created by the parts themselves.

Roles: A role is a tag defined by the system to describe the function of the part in a larger musical scheme. This function is often determined by the particular MIDI sound associated with the notes in the part. For example, the role of a part whose notes are playing the Roland JV1080 Acoustic Bass patch, may be determined to be bass.

Elements: Elements are parts that contain static lists of notes. Elements are often passages extracted from music in the database. In one embodiment, musical material enters the system through an element. An element's output is the notes it contains.

Nodes: Nodes are functional elements which generate a result list of notes by operating on one or more other nodes, which may be referred to as source nodes. Nodes are linked together in a web of source connections.

Different types of nodes use different algorithms for generating their results. A simple example is a TimeScale node which can speed up or slow down a passage of music by applying a scalar to the attack times of a copy of the result of the TimeScale's source node. The rhythmic attractor is an example of a more complicated node. A rhythmic attractor has two source nodes. It causes the rhythm of a copy of the result of one source node to become more like the rhythm of the result of the other source node. Each type of node can have any number of sources.

Virtual zones: a virtual zone is a type of node used to introduce musical material into an agenda. Virtual zones act as placeholders in configurations of agendas within the program. All nodes which ultimately reach back to a particular virtual zone as a source will have their outputs changed whenever the virtual zone is set to reference a different zone. Each virtual zone gets a list of potential zones from the environment. One zone from the list is selected to be the zone referenced by the virtual zone. The virtual zone's output is then a copy of the zone's output. At the beginning of each strand of nodes is a virtual zone, which are the only nodes with no source. Virtual nodes are special nodes which contain a copy of the output of some part which is not a node.

Virtual zones typically have their potential zones loaded with zones which play similar roles. For instance a virtual zone might have potential zones which are all kick drum parts.

Agendas: Agendas are high-level elements that are used to encapsulate the processes used to create a passage of music, and ordinarily contain a list of nodes.

A subset of the nodes listed in an agenda are summed together to create the agenda's list of result notes. At its simplest, an agenda might consist of a single virtual zone. The result of the agenda would then be a copy of the output of the zone referenced by the virtual zone. An agenda might alternatively be composed of many nodes linked together to create results which are the results of node's operations on various combinations of source nodes. The audible nodes would most likely include nodes at the ends of these processing chains of nodes but could as well include any of the nodes belonging to the agenda. In one embodiment, a node can only be used as a source for other nodes belonging to the same agenda. Zones, on the other hand, can be referenced by virtual zones in any agenda, as long as circularity among nested agendas does not occur.

An agenda can also be referenced by a virtual zone belonging to another agenda. Therefore agendas can play the same role in the architecture as elements. Nested agendas can represent sections of music which are constituents of larger sections. The hierarchical structure of the program is process-based rather than analysis-based.

As discussed above, virtual zones act as a placeholder in configurations of agendas within the system. All nodes which ultimately reach back to a particular virtual zone as a source will have their outputs changed whenever that virtual zone is set to reference a different zone. This allows one configuration of agendas and nodes to create many different results without changing the configuration itself.

Sharks: Sharks are virtual zones which are used to find pairs of excerpts in the database which are close enough in role and rhythmic structure to be good candidates to substitute for each other in certain settings. Sharks augment the filtering of potential zones occurring in virtual zones by comparing the rhythms of potential parts to the rhythm of a chosen target zone. Given a particular bass line, for instance, a shark searches through the zones in the environment for excerpts of bass lines which have a similar rhythm to the target bass line.

Assemblers: An Assembler is an object which creates a configuration of nodes on an agenda. Assemblers have no output of their own. The output of the agenda is the result of using an assembler. Assemblers create commonly used configurations which are time-consuming to program. The configuration produced by an assembler can be edited, nonetheless, and more than one assembler can operate on a given agenda. In one embodiment, each assembler can operate on only one agenda.

Analysis: In one embodiment of the present invention, structural and organizational information for note lists is also stored. This information, called an analysis, is based on phrasing and other musically significant structural features. It is stored in a hierarchical tree whose layering and structure represents the particular organization of the sequence of notes. Thus, in one embodiment, groupings and associations between groupings of notes may be used in developing new musical constructs.

Overall Architecture and Hardware Configuration

Referring now to FIG. 1, there is shown an overall architecture of an embodiment of the present invention, designated as system 100. Any of the elements and components shown in FIG. 1 will be described in more detail in connection with the other figures. The arrangement of components shown in FIG. 1 is merely exemplary, and one skilled in the art will recognize that the various components shown therein could be arranged in many different configurations without departing from the spirit or essential characteristics of the present invention.

MacOS CPU 102 represents a computer running the Macintosh Operating System, version 8.0, from Apple Computer. A preferred embodiment of the present invention is implemented to run on a 200 MHz or better 604e Macintosh computer, with at least 96 Mbytes of random-access memory (RAM). Other types of computer hardware could also be used.

The operating system is enhanced by installation of a MIDI driver such as MidiShare 122, a widely-available public domain driver, in order to allow computer 102 to communicate with MIDI devices. User 101 interacts with system 100 through computer 102.

A MIDI interface card, such as an OPCode Studio 4 MIDI interface (not shown) is installed in computer 102. Computer 102 is connected via the MIDI interface to two devices: a Roland JV1080 synthesizer 103 (which has Roland Vintage Synthesizer and Roland Orchestral expansion boards installed), and an Akai S2000 sampler 104 containing 32 Mbytes of RAM for storing samples of musical selections. The sampler is typically loaded with appropriate musical samples before commencing operation of system 100. Devices 103 and 104 are connected to a line mixer 105 and amplifier (not shown), so that their sound output can be played over speakers 10(). The audio output of the invention may also be routed to a conventional recording device, such as a tape recorder (not shown), for further use. In, addition, the invention produces as output a MIDI file (not shown) which can be used to control sound modules via the MIDI interface. This MIDI file can be further edited and processed by a trained engineer if desired. Of course, one skilled in the art will recognize that other types of computers, operating systems, MIDI-enabled devices, and other equipment, could be used in place of those shown.

No interaction between the user of the invention and devices 103, 104 synthesizers is required beyond the initial setup. System 100 controls all necessary patch and control changes for the sound modules through the MIDI interface 20.

Database 107 contains musical material, and resides on a conventional hard disk (not shown) for operation with computer 102.

Operation of the system can best be described by way of an (example. At the beginning of the compositional process, the user selects one or more references. A reference is a musical selection chosen from among many available selections from database 107. This choice is made using GUI tools which facilitate browsing through the references while applying certain user-adjustable filtering criteria. Each selected reference in some way embodies one or more essential elements of the user's desired piece. For example, the user may know that he or she wants to generate a piece of slow, sad jazz. By adjusting the GUI filters, he or she browses through the menu of references, listening to slow, sad jazz excerpts until he or she finds one or more that seem close to what is sought.

Virtual zones 108, 109, 110, and 111 are used to introduce material from database 107. User 101 can freely adjust the musical material that each virtual zone references, without disturbing any of the dependent nodes or their connections to each other. Nodes include, for example, time filter 113, groove filter 112, fragmenter 123, and other elements shown in FIG. 1. Virtual zones are defined as selections made from a pool of user-defined elements (not shown), which are taken from database 107 and which correspond to some selection criteria specified by user 101. For example, such selection criteria may include genre selections ("house", "baroque", (etc.), adjectives ("happy", "uptempo", etc.), or musical function (e.g. bass line).

For purposes of illustration, let us assume that the user has picked three references: a fragment of slow, sad jazz (Reference A), a fragment of angry urban hip-hop music (Reference B), and a fragment of sweet, medium-tempo disco music (Reference C).

Virtual zones are the result of user interaction with a groove filter 112. Groove filter 112 is a software component for selecting particular virtual zones containing particular musical characteristics. The characteristics used by groove filter 112 are defined based on a selected musical fragment from database 107 which is specified by the user. The selected musical fragment forms a virtual zone designated as a target 108, 111 in the architecture shown in FIG. 1.

The particular virtual zones in a composition task are contained within a single agenda. As described above, an agenda is a source for two separate computation streams shown in FIG. 1 as attached to each of virtual zones 109 and 110. One skilled in the art will recognize that the computation streams shown herein are merely exemplary of the types of operations that may be implemented using the techniques of the present invention.

First, the user creates a new, empty agenda. For use in this agenda a groove filter 112 is designated, and its target 108 is set to Reference2 B. The user adjusts the parameters on the groove filter 112 (as will be described in more detail below) to allow a fair degree of looseness in the application of the filter, thus specifying that a considerable amount of variation and exploration is desired. Alternatively, the user may adjust the parameters so that the output of groove filter 112 would more closely resemble the chosen target fragment.

By running groove filter 112, the user fills the agenda with a series of audible nodes through virtual zone 108. Thus groove filter 112 has a single target virtual zone 108, which the user sets to a musical fragment from database 107 which is similar to the kind of music the user wants to create. Groove filter 112 then does the work of selecting from the elements pool a series of virtual zones 109–111 which contain material that is analogous to the material contained within target virtual zone 108. In one embodiment, groove filter 112 dynamically instantiates virtual zones 109–111.

Each node represents a part, or track, created to approximate the rhythmic material associated with a particular track in the target fragment. The user can listen to this group of audible nodes either individually or as a whole. At this point, the user is listening for the rhythmic interplay among the parts, and the overall rhythmic character of the passage, ignoring any pitch-based or timbral concerns. The user can run the groove filter 112 repetitively, each time getting a unique solution to the problem of rhythmically approximating the target. If the user continues to be dissatisfied with the output, he or she can adjust the target distance, or other key parameters, or even change the specified target fragment.

Virtual zone 109 begins with time filter node 113. Time filter node 113 adjusts attack time and duration of notes .

Contextual attractor 114 is provided in one embodiment of the present invention, but is not required in all embodiments. Contextual attractor 114 uses structural information developed in the analysis of a note list, such as phrasing, as described above. Source nodes may be made more like target nodes with reference to this higher-level structural information using a contextual attractor, in a similar manner to the harmonic and rhythmic attraction associated with the harmonic and rhythmic attractors.

Contextual attractor 114 operates as follows: First, it finds an optimal mapping between groups of source and target, by comparing known structural features such as phrasing. Next, it modifies the source groups so as to make them more similar to the target groups, in terms of the structural features. In doing so, contextual attractor 114 draws analogies between the harmonic function of each note within its source group, and that source group's corresponding target group.

One skilled in the art will recognize that contextual attractor 114 is a feature which is included in one embodiment of the present invention, but which is not necessary to practice other embodiments of the invention.

Harmonic attractor 115 imposes harmonies from the second musical fragment onto the output of contextual attractor 114. The musical fragment used by harmonic attractor 115 may be selected by user 101, and generally provides a harmonic analogy. In conjunction with running harmonic attractor 115, the user chooses a new target fragment, this being chosen for its pitches and harmonies, not for its rhythmic character.

For purposes of this example, assume the user chooses a passage of simple baroque music containing a passage of basic chordal harmonies. This will constitute the harmonic target. The output of contextual attractor 114 may be designated the harmonic source. The user now creates a new empty agenda, and brings the harmonic target and the harmonic source into that agenda. The user creates a harmonic attractor 115 (as will be described in more detail below). The user specifies the target distance, which is a specification of how closely the source is to follow the harmonies represented in the target. Other values of the harmonic attractor 115 may be left to their defaults. By running the harmonic attractor 115, the user's output piece now has a coherent harmonic character, which contains the harmonic essence of his chosen harmonic target, while retaining all of the rhythmic and timbral features of his original harmonic source.

Output of harmonic attractor 115 is patched in parallel to three nodes: chord substitution node 116, which further alters harmony based on triadic harmony theory; invert pitches node 117, which inverts the contour and distorts the modality of the notes; and transpose node 118, which transposes the pitch of the notes in the musical fragment by some fixed amount. The result of the transpose node is routed to a TimeScale node (not shown), which distorts the time base of the notes.

Three parallel musical variations are now available, as generated in parallel by nodes 116, 117, and 118. These variations are then arranged sequentially in time by sequencer 119, so that they create a sense of musical development or evolution over time. Invert pitches node 125 is also patched into sequencer 119, as will be described in more detail below.

Virtual zone 110 sends notes to fragmenter 123 which shuffles and repeats small subsections containing groups of notes. Output from fragmenter 123 is patched into harmonic attractor 124, which has a harmonic target specified by user 101. In this case, the target is a shark, which is a type of target capable of performing automatic searches on database 107, as will be described in more detail below. The user is able to select criteria (rather than a single musical fragment), and the shark target then finds candidates in database 107 which best match the specified criteria.

Output from harmonic attractor 124 is provided to invert pitches node 125, which doubly-distorts the modality of the notes. Output from node 125 is provided to sequencer 119, along with output from nodes 116, 117, and 118 as was described above.

Output from sequencer 119 is passed to repeats node 120, which loops the musical sequence a number of times, as specified by the user. Output from repeats node 120 is passed to sequencer 121, along with output from groove attractor 126. Groove attractor 126 is an assembler which takes the audible nodes of an agenda and cause the rhythms of each audible node to become more like the rhythms of the corresponding instrument parts of a multi-instrumental target zone. Thus, groove attractor 126 separates the notes into component instrumental parts, applying rhythmic attractor 127 to each part in parallel, as will be described below. Rhythmic attractor 127 causes rhythms for individual parts to become more like rhythms of a target.

Sequencer 121 now contains a large list of notes which have passed through various processing stages, and are ready for the user to audition.

Sequencer 121 takes an arbitrary number of input nodes and arranges them serially in time, according to simple patterns of repetition. Sequencer 121 provides automation of sequential arrangement that is well known in the art. By running sequencer 121, the musical fragments are ordered and repeated in a musical way, e.g., according to canonical patterns of musical structure, in order to create a complete musical passage. The user runs the sequencer, adjusting parameters until he is satisfied with the output.

The final sequence is provided to the user via MidiShare 122 and computer 102.

As stated above, the particular arrangement of components shown in FIG. 1 is merely exemplary of a large number of configurations that could be employed without departing from the claimed invention.

The user now has a completed piece of original music. It bears the rhythmic and harmonic imprint of a pair of different target imprints, but consists of entirely new musical material.

Software Environment

Figure 2:
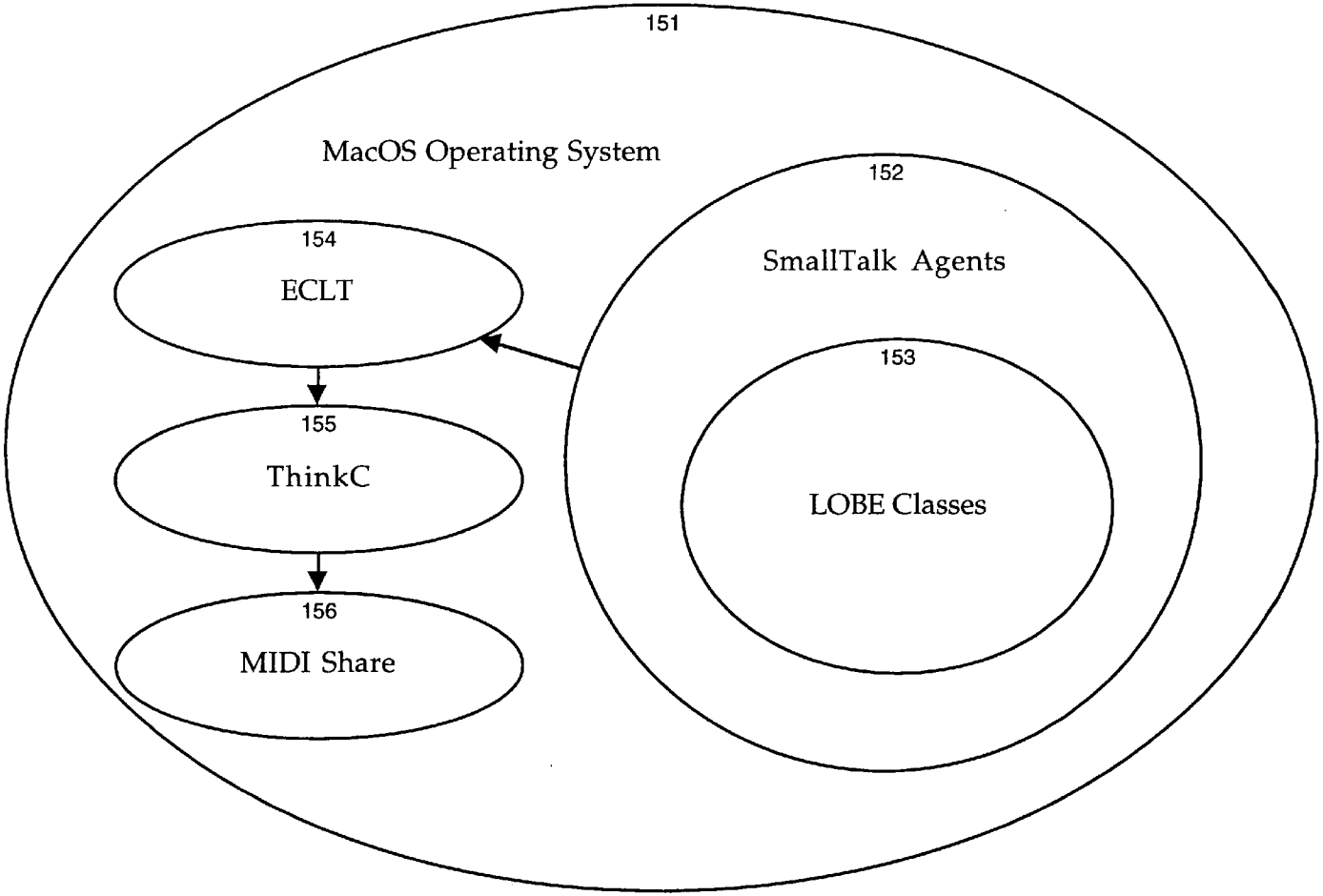
FIG. 2 is a block diagram depicting the software environment in which the present invention operates.

Referring now to FIG. 2, there is shown a block diagram of the software environment for an embodiment of the present invention, including the relationships among various software components. The illustrated embodiment is implemented in the programming language Smalltalk as implemented for computers running the MacOS operating system 151, in the development product Smalltalk Agents 152 from Quasar Knowledge Systems. MIDI communication is accomplished through the MIDI driver MidiShare 156 by Grame. External code is indicated as ECLT 154. The present invention is implemented using the C programming language as provided for the MacOS in the product Think C 155 by Symantec. Think C 1155 provides the interface between Smalltalk code and the MIDI driver. Also certain low-level numerical routines are implemented in C to gain a performance increase in relation to Smalltalk execution time.

The software architecture and user interface of the present Invention follow the object-oriented paradigm suggested by the Smalltalk language. As is well-known in the art, object-oriented software development incorporates refinement (hierarchy), polymorphism, and encapsulation. In accordance with these concepts, the present invention employs well-known techniques of object-oriented design. Elements of musical design are implemented as objects which are a combination of attributes and roles. More generic objects are refined into more specific types of scales through specialized subclasses. For example, a scale object is refined into a diatonic scale in such a manner. Polymorphism is used throughout the software architecture to provide specific behaviors for widely used musical interactions between varied objects. Encapsulation is an important element of the invention's approach to musical form. Combinations of musical design elements can be treated as atomic units in the creation of higher level combinations of design elements. This kind of encapsulation is evident in the user interface as it is used to specify the level of detail desired by the user for a particular task.

System Elements

The above-described elements of the preferred embodiment of the invention will now be described in greater detail.

Rhythmic Attractor

Rhythmic attractor 127 is a device used to cause one collection of notes (the source) to more closely manifest the rhythmic character of another collection of notes (the target).

For illustration, assume the source and target passages are each one bar long, and that the smallest rhythmic value to be considered is the sixteenth note. The beginning of each note in the passage is called an attack. The attacks for each passage are represented by a sixteen-bit binary vector, where each bit represents a corresponding time-ordered sixteenth-note position in the passage. Each bit is set to 1 if a note attacks at that sixteenth-note position, or 0 if no note attacks at that position. The resonance between attacks in the attack vector is then calculated using the binomial measure (described below) to amplify the relative importance of attacks related by both time proximity and beat strength. For instance, a syncopated note would possibly have greater resonance with another syncopated note than with still another note which might actually be closer in time to the original note. The normalized, complement coded resonance vector is used to represent the rhythm of the passage for purposes of comparison.

Each bit in the attack vector of the source passage is toggled on or off away from its original value to test whether the insertion or deletion of a single attack will decrease the angular distance between the resonance vector for the target and the resulting resonance vector for the source. The order in which the bits are tested is based on beat strength, with weakest beats being tested first. Once the angular distance between the resonance vectors representing the source and target is below the desired threshold, no further alterations are made to the source attacks.

The duration of each modified source note can optionally be set to that of the corresponding target note.

When using the rhythmic attractor on pitched material, the pitches for any new attacks in the source passage are based on the pitches for other notes in the source which have the highest resonance with the new attack.

The rhythmic attractor can be used on longer passages by partitioning the passages into time windows, typically one or two bars, and applying the above procedure to each pair of corresponding time windows in the source and target.

Figure 3:
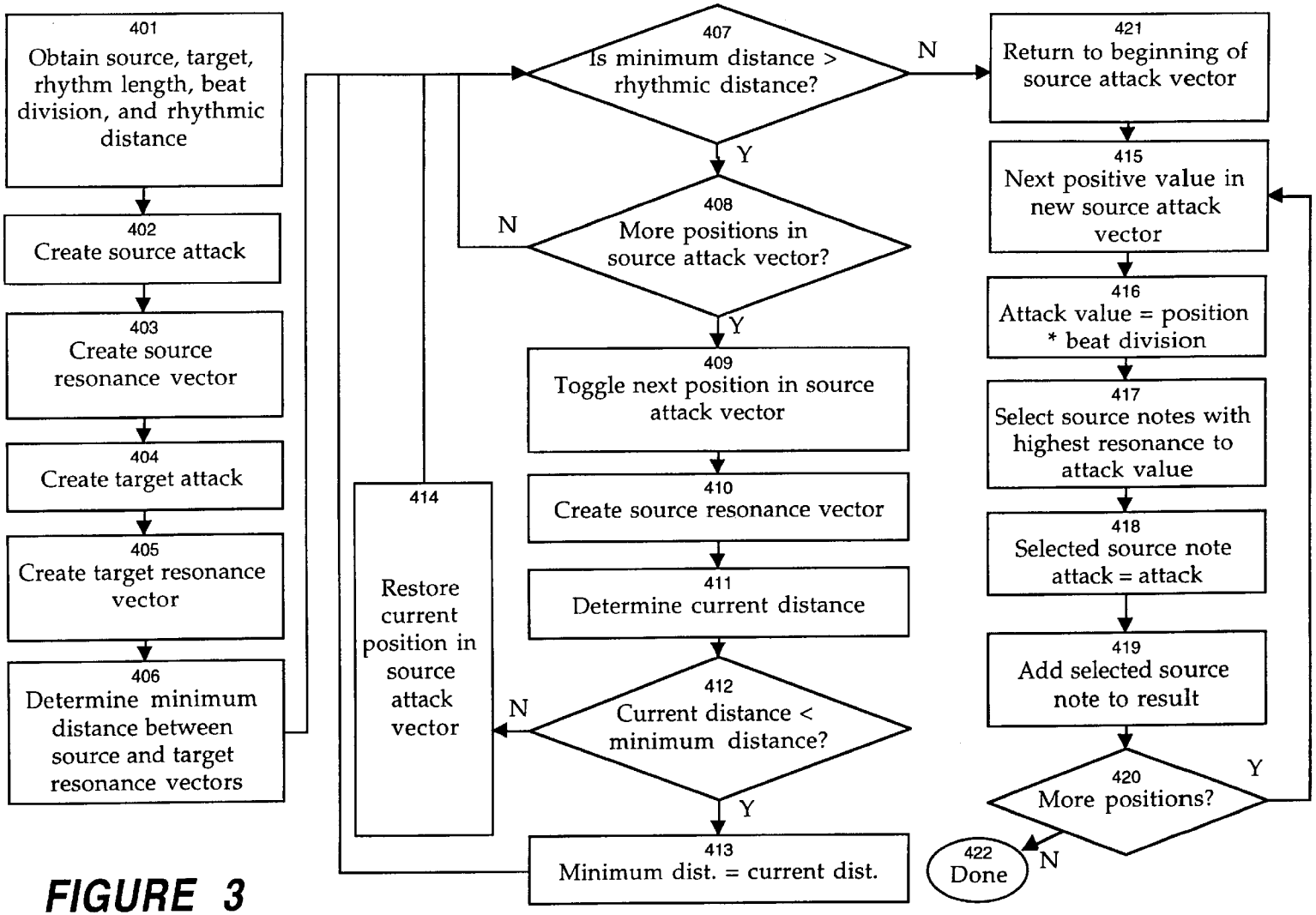
FIG. 3 is a flowchart depicting the rhythmic attractor feature of the present invention.

Referring now to FIG. 3, there is shown a flowchart illustrating the operation of the rhythmic attractor. Initially, at step 401 the rhythmic attractor is given a list of notes which the user wants to modify. These are called the source notes. The user also provides a list of notes called the target. The notes in the target have been chosen by the user because they have a rhythmic character which the user wants to impart to his source notes.

In step 401, the user also specifies a rhythm length, which represents the span of time over which the invention will modify the notes; a beat division which specifies the number of subdivisions of the basic beat which should be represented (this can be thought of as the level of quantization of time); and finally, a rhythmic distance, which is a floating point value ranging between 0 and 1. The smaller the distance (closer to 0) the more nearly the source will be made to emulate the rhythm of the target.

In step 402 the source notes are translated into an attack vector representation. This is a vector designed to capture the distribution of attacks (beginnings of notes). This attack vector is then translated by step 403 into a resonance vector representation. This is a vector which represents the attack times of a group of notes, with a structure designed to emphasize the strong and weak relationships among different attack times against a regular musical meter.

Next, in step 404 the target notes are translated into attack vector representation. This is a vector designed to capture the distribution of attacks (beginnings of notes). Then this attack vector associated with the target notes is translated into a resonance vector representation, as was the source attack vector in step 403.

System 100 then determines, in step 406, the current distance between the two resonance vectors. This distance is a measure of the proximity, or relatedness, of the source notes to the target notes. As long as this distance is greater than the user-specified rhythmic distance, system 100 will perform the following steps 407 to 413, which will now be described in turn.

The source attack vector consists of 0's and 1's, with each 0 or 1 representing the absence or presence of a note attack (beginning) at a particular moment of time. Each position may also be referred to as a bit. Starting from the left-most position (index 0), system 100 moves through the vector one position at a time. For each position in the source vector, system 100 performs steps 407 to 413.

System 100 in step 409 toggles the value of the bit at the current position. In musical terms, this means we are adding or deleting a note attack at the point in time corresponding to our current position in the attack vector.

In step 410, system 100 creates a resonance vector on the modified attack vector. Next, in step 411, system 100 measures the vector distance between the modified source and target vectors to determine if the change made to the source causes the source to move closer to the target in the space represented by these resonance vectors. Vector distance may be determined, for example, by Euclidean distance measures, as will be described in more detail below.

In step 412, system 100 determines if the current vector distance is less than the user-specified minimum distance. This determination indicates whether or not the modification has in fact moved the source music selection closer to the target music selection. If it has, system 100 preserves this change to the source attack vector (step 413). If the change failed to move the source closer to the target, the invention restores the source to its original value (step 414). Then the invention repeats the previous steps 407 to 413 on the next position to the right in the source attack vector.

If the modification is successful, the modified source attack vector now represents a rhythmic profile which was derived from the original source, but which has been iteratively manipulated until it comes within a user-specified distance from the target. Next, in steps 415 to 420, system 100 cycles through this modified attack vector, converting from its simple representation back into notes.

System 100 returns, in step 421, to the beginning of the source attack vector. In step 415 it moves through the new source attack vector from left to right, looking for values of 1, which represent the presence of a note attack. For each of these 1's it first determines the slice of time which corresponds to the particular position of that 1 within the attack vector (step 416). Then it compares the original, unmodified source, at that attack lime, and gathers up the notes which are closest to that attack time, based on a measure of resonance values (step 417). Notice that this closeness to the attack time is not simple proximity, but contains a measure of closeness based on relative beat strength as well. For example, assume that our modified source attack vector has a 1 in its first position. This represents time 0 in the source. System 100 looks in the original source at time 0, and discovers that there are no notes which attack at that exact time. The invention now broadens its search, in two ways. First, it looks at immediately adjacent times, and then it looks at other times which, while not necessarily adjacent, have the same beat strength as time 0. This immediate, linear proximity with a proximity based on beat strength lies at the heart of the resonance vector representation.

In steps 418 and 419, for each note in the source which system 100 determines corresponds to the 1 in the modified source, it creates a copy of that note, and set its attack to the time represented by the position of the 1. This note is added to an accumulating list of finished notes (the result). If, in step 420, more positions exist in the source attack vector, system 100 returns to step 415.

Attack Vector

Figure 4:
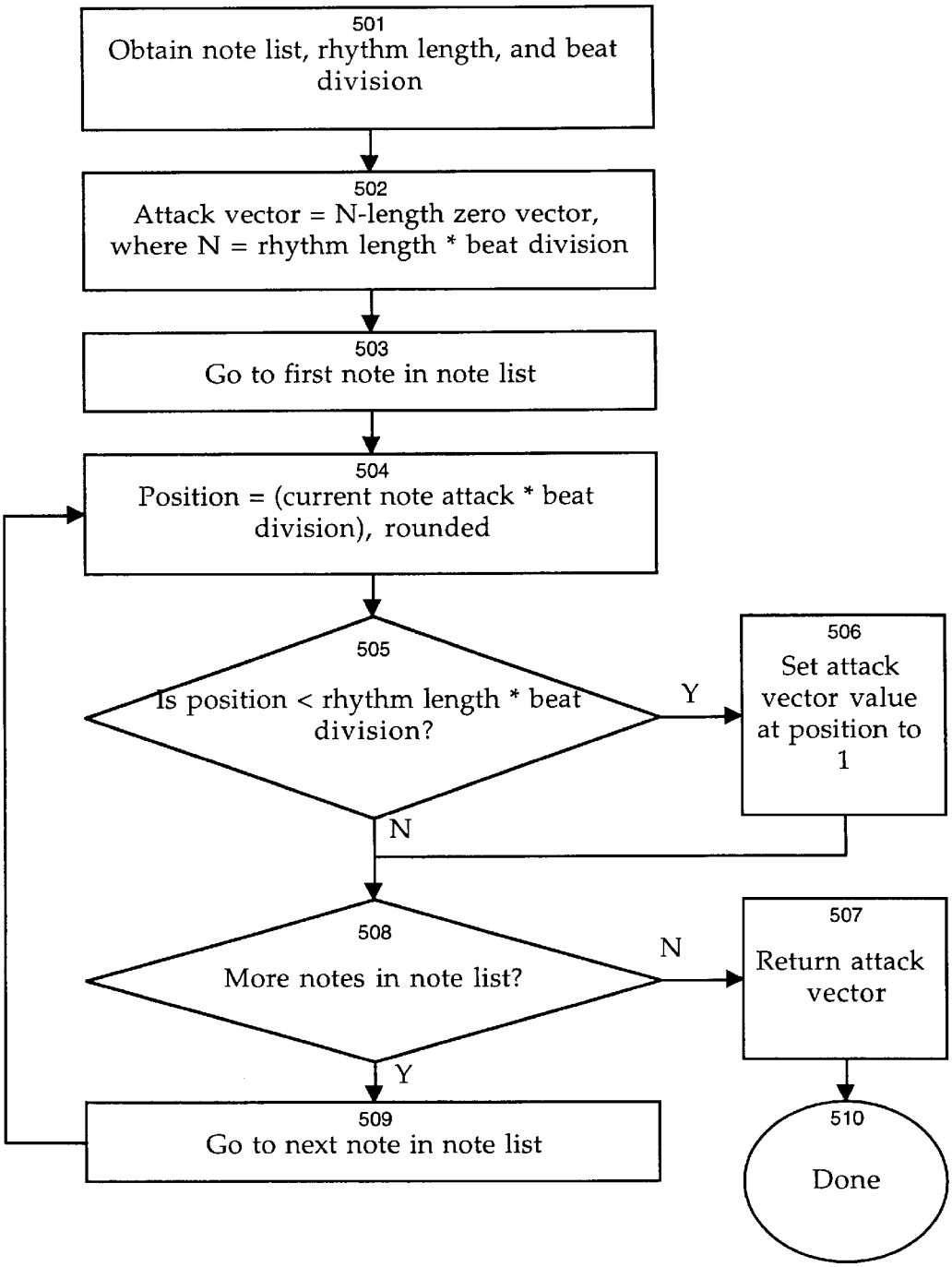
FIG. 4 is a flowchart depicting the element of the present invention that creates an attack vector.
Figure 5:
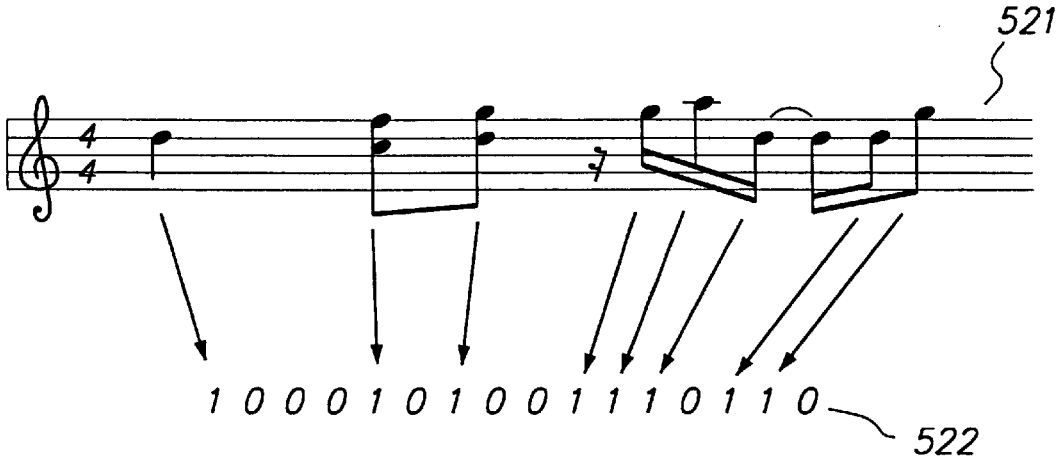
FIG. 5 is an illustration showing the relationship between a sample musical fragment and its corresponding attack vector representation.

Referring now to FIG. 4, there is shown a flowchart depicting the steps that the invention performs to create an attack vector, as referenced in connection with steps 402 and 404 in the above description. An attack vector is a representation of rhythmic data embodied by any arbitrary list of notes. It is way of breaking down the rhythms of a musical passage into a series of 1's and 0's which correspond to the presence and absence of note attacks. Referring also to FIG. 5, there is shown an illustration depicting the relationship between a sample musical fragment 521, and its corresponding attack vector representation 522.

Initially, in generating an attack vector, system 100 obtains a list of notes which are to be represented. System 100 also obtains a rhythm length, which represents the span of time over which the program modifies notes, and a beat division which specifies the number of subdivisions of the basic beat which should be represented. Beat division can be thought of as the level of quantization of time for the attack vector.

System 100 initializes, in step 502, an N-length zero vector: a vector filled with the number 0. Each position in the vector is able to hold a bit having a value of 1 or 0. N (the size of the vector) is determined by multiplying the rhythm duration by the beat division. System 100 begins in step 503, with the first note in the note list. In steps 504 to 509, system 100 moves through the list of notes. For each note, in step 504, it determines the position in the attack vector corresponding to the attack time of that particular note. The position is determined by multiplying the note's attack time by the beat division, rounded to the nearest integer. After checking, in step 505, that this position is contained within the vector size, system 100 sets, in step 506, the bit in the position to the value of 1. If, in step 508, there are more notes in the note list, system 100 proceeds, in step 509, to the next note, and returns to step 504. Thus, for every note in the list, the program places a 1 in the vector at the vector position corresponding to that note's attack. Once all notes have been processed, system 100, in step 507, returns the attack vector.

Resonance Vector

Figure 6:
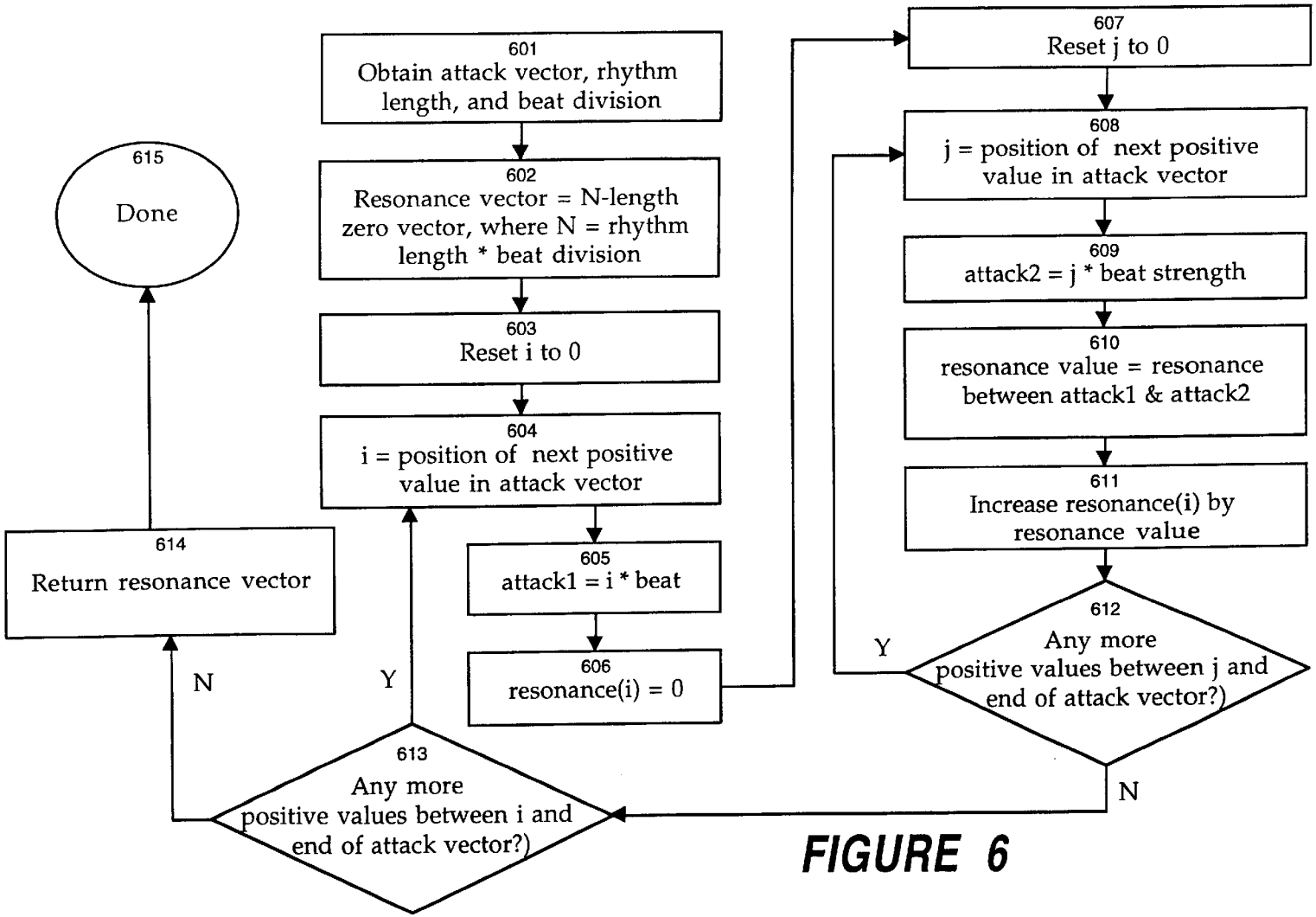
FIG. 6 is a flowchart depicting the element of the present invention that creates a resonance vector.

Referring now to FIG. 6, there is shown a flowchart depicting the steps that the invention performs to create a resonance vector, as referenced in connection with steps 403, 405, and 410 in the above description. A resonance vector is an advanced representation of rhythmic data, that is derived from an attack vector in the following manner.

Initially, system 100 obtains an attack vector (as described above in connection with FIG. 4), rhythm length (which represents the span of time over which to modify notes), and a beat division (which specifies the number of subdivisions of the basic beat which should be represented). Generally, the rhythm duration and beat division have the same values as the corresponding parameters used in the creation of the attack vector as described above in connection with FIG. 4.

System 100 initializes, in step 602, an N-length zero vector: a vector filled with the number 0. Each position in the vector is able to hold a value from 0 to some maximum. N (the size of the vector) is determined by multiplying the rhythm duration by the beat division. Next, system 100 steps through the attack vector in an outer loop, using an index designated as i. For each position in the vector which is non-zero, the invention creates a resonance measure of that position relative to all of the other non-zero positions in the vector, as follows.

In step 603, i is set to 0. In step 604, i is incremented to the position of the next positive value in the attack vector. For this position of i, in step 605 a value of attack1 is set to the product of i and the beat strength. Thus, attack1 is a representation of the temporal position of the note being analyzed. In step 606, a resonance value for i is set to zero. In step 607 a second index value j is set to 0. In steps 608 to 612, system 100 steps j through the attack vector, so that the resonance between the note represented by index i and each other note represented in the vector is considered, as follows.

In step 608, j is incremented to the position of the next positive value in the attack vector. For this position of j, in step 609 a value of attack2 is set to the product of j and the beat strength. Thus, attack2 is a representation of the temporal position of the note represented by index j. Next, in step 610, system 100 determines a resonance value between attack1 and attack2, as will be described in more detail in connection with FIG. 7. In step 611, the resonance value for position i is increased by the resonance value determined in step 610.

If, in step 612, system 100 determines that more positive values exist in the attack vector between the position of j and the end of the vector, steps 608 through 612 are repeated. If not, system 100 proceeds to step 613.

If, in step 613, system 100 determines that more positive values exist in the attack vector between the position of i and the end of the vector, steps 604 through 613 are repeated. If not, system 100 proceeds to step 614.

In step 614, system 100 returns the resonance vector.

Resonance Between

Figure 7:
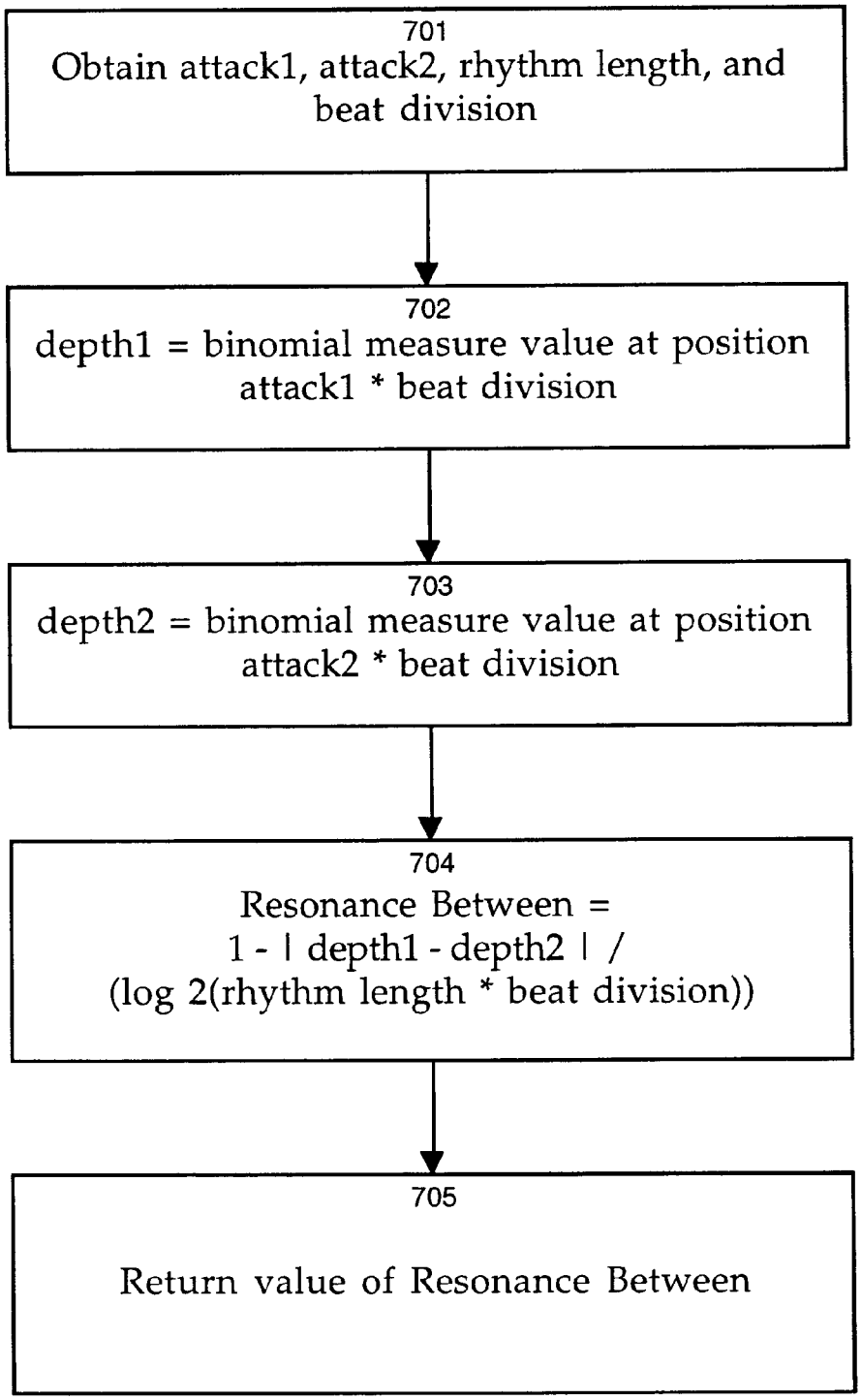
FIG. 7 is a flowchart depicting the element of the present invention that determines the resonance between two passages of music.

Referring now to FIG. 7, there is shown a flowchart depicting a method for determining resonance between two attack times, as performed in step 610 of FIG. 6. The Resonance Between feature determines a value that can be determined for any two attack times. The higher the value, the greater the relationship between the two attack times. The value of Resonance Between is a function that varies with both linear proximity, and proximity in terms of the metric notion of beat strength.

In step 701, system 100 obtains a rhythm length, which represents the span of time over which the invention modifies the notes, and a beat division, which specifies the number of subdivisions of the basic beat to be represented. System 100 also obtains two attack times, designated attack1 and attack2, representing specific notes to be compared in order to determine a resonance value.

In step 702, system 100 determines a value, designated depth1, by indexing into a binomial measure according to the rounded value of attack1 multiplied by the number of divisions per beat specified, and reading the value at that position. The binomial measure, also known as the Bernoulli or Besicovitch measure or the 1's counting sequence, is a well-documented multi-fractal number series, widely referred to in the mathematical literature concerning iterative functions. See, for example, C. Evertsz and B. Mandelbrot, "Multifractal Measures", in *Chaos and Fractals;* and M. Schroeder, *Chaos, Fractals, and Power Laws.* It is derived by taking the number of 1's in a binary representation of a positive integer. Its first few terms are given below:

| Index | Binary | Binomial Measure |
|---|---|---|
| 0 | 0 | 0 |
| 1 | 1 | 1 |
| 2 | 10 | 1 |
| 3 | 11 | 2 |
| 4 | 100 | 1 |
| 5 | 101 | 2 |
| 6 | 110 | 2 |
| 7 | 111 | 3 |
| 8 | 1000 | 1 |
| 9 | 1001 | 2 |
| 10 | 1010 | 2 |
| 11 | 1011 | 3 |
| 12 | 1100 | 2 |
| 13 | 1101 | 3 |
| 14 | 1110 | 3 |
| 15 | 1111 | 4 |
| (etc.) | | |

The value of the Nth term is used, where N is the rounded value of attack1 multiplied by the number of division per beat specified.

The binomial measure tends to give similar values for points which are either close to one another in time or close to one another in beat strength (so that they are separated in time by a power of two). For example, in the series as shown above, positions 1, 2, 4, and 8 have highest resonance with the downbeat at position 0. Conversely, positions 7, 11, 13, and 14 have higher resonance with the final time slot at position 15. The degree of resonance is thus well represented by the proximity in value of the binomial measure.

In step 703, system 100 determines a value of depth2, by indexing into the above binomial measure series according to the rounded value of attack2 multiplied by the number of divisions per beat specified, and reading the value at that position. Next, in step 704, system 100 applies the following equation to the two values depth1 and depth2:

$$R = 1 - \frac{|depth1 - depth2|}{(\log_2(rhythmlength * beatdivision))} \quad \text{(Eq. 1)}$$

where R=the value for Resonance Between. This is a value between 0 and 1 which is a measure of the rhythmic resonance (or relatedness) between the two given attack times.

Vector Distance

The vector distance is a value computed from any two vectors, which represents how closely aligned are the two vectors. The vector distance is a numeric value representing the relative degree of alignment between the data represented in the n-dimensional space of the vectors. These can be simple attack vectors, resonance vectors, or harmonic vectors.

In one embodiment of the invention, distances between harmonic vectors are determined by reference to the angle between the vectors. Given two vectors V1 and V2, the angle between the vectors is given by the equation:

$$D = \arccos\left(\frac{V1 \cdot V2}{|V1| * |V2|}\right) \quad \text{(Eq. 2)}$$

Harmonic attractor 115 uses the angle between pitch vectors, given by Eq. 2, as a measure of harmonic distance between the pitches.

In one embodiment, distances between rhythmic vectors (attack vectors and resonance vectors) are determined by reference to Euclidean distance measures. Euclidean distance between attack vectors is given by the equation:

$$D_{rhythmic} = \sqrt{(a_0 - b_0)^2 + (a_1 - b_1)^2 + \ldots + (a_n - b_n)^2} \quad \text{(Eq. 3)}$$

where a and b are attack vectors of length n.

Harmonic Attractor

In a preferred embodiment, the harmonic attractor 115, 124 of the present invention causes one collection of notes (the source) to more closely manifest the harmonic character of another collection of notes (the target). By using the tool on any pair of musical fragments, a wide assortment of musical hybrids and variations can be generated, by varying parameters, as will be described in more detail below.

Figure 8:
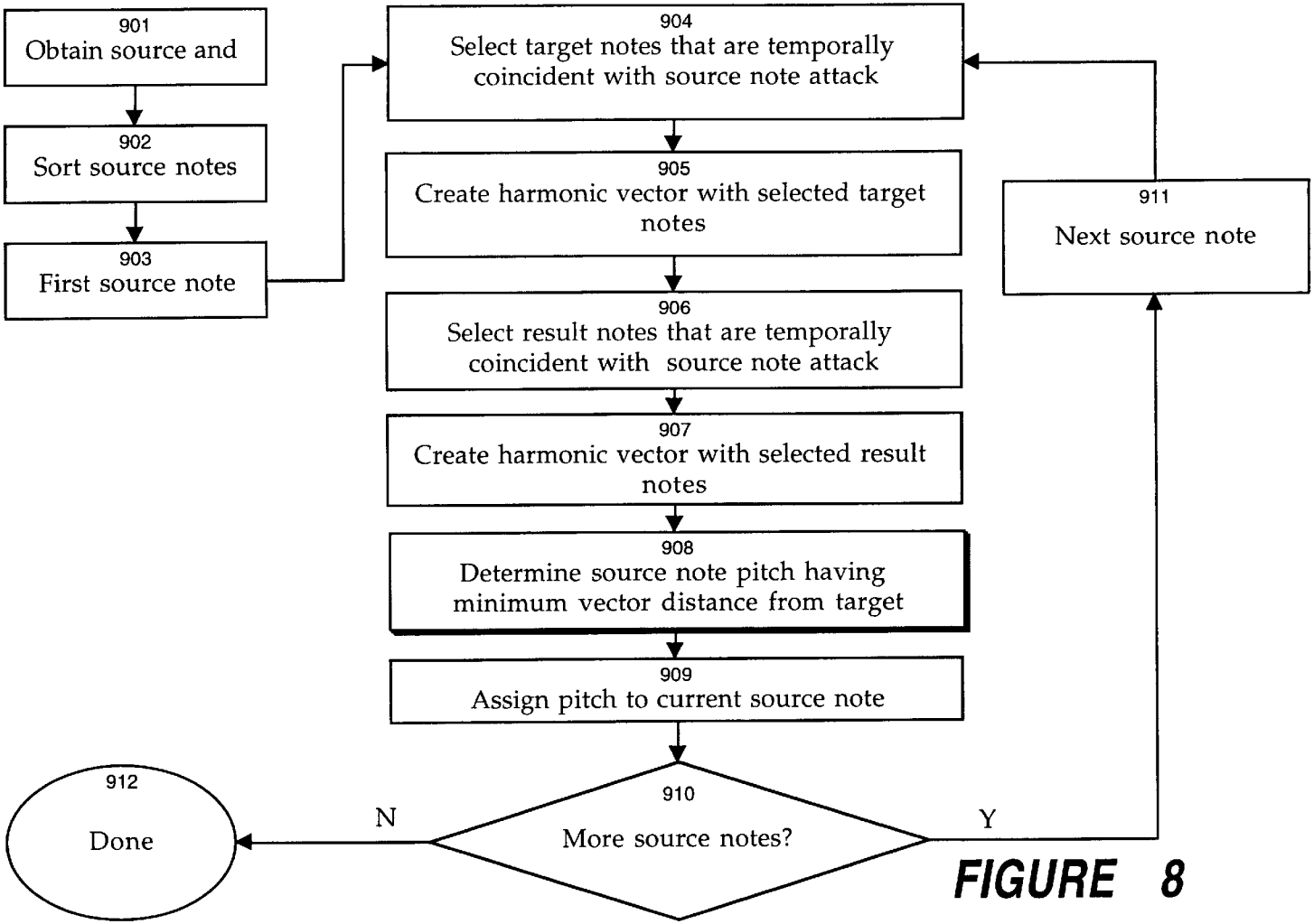
FIG. 8 is a flowchart depicting the functional operation of the harmonic attractor element of the present invention.

Referring now to FIG. 8, there is shown a flowchart depicting the operation of the harmonic attractor feature of the invention. In step 901, system 100 obtains a source and target fragment. Each fragment contains a list of notes to be operated on by the harmonic attractor. The harmonic attractor operates on source and target fragments so as to impart harmonic character onto the source fragment, based on the target fragment.

System 100 may also obtain a harmonic distance, which is a floating point value ranging between 0 and 1. The smaller the distance (closer to 0) the more nearly the source will be made to emulate the harmony of the target.

In step 902, system 100 sorts the source notes by pitch and attack. In steps 903 to 911 the harmonic attractor steps through all of the source notes, beginning in step 903 with the first source note. In step 904, system 100 finds all of the notes in the target which are temporally coincident with the point in time corresponding to this note's attack. In other words, system 100 finds the notes in the target that occur simultaneously with the source note at the moment of its attack.

In step 905, system 100 creates a harmonic vector for the selected target notes, as will be described in more detail below.

In step 906, system 100 selects all of the notes in an accumulating output (this will be empty at first) which are temporally coincident with the point in time corresponding to this note's attack. In other words, system 100 finds the notes in the accumulating output that occur simultaneously with the source note at the moment of its attack. In step 907, system 100 creates a harmonic vector for the selected result notes, as will be described in more detail below.

In step 908, system 100 determines a pitch for the source note whose vector has a minimum angle from the target note (see Eq. 2), so as to determine the transposition for the current source note which brings it closest to the harmony represented by the target at the point in time occupied by the source note, according to a technique described below in connection with FIG. 9. In performing this determination, system 100 uses the harmonic distance previously determined, with smaller distance values indicating closer emulation of harmony.

In step 909, system 100 applies the selected pitch to the source note, and adds the newly-transposed source note to the accumulating output result. If, in step 910, more source notes are available, system 100 selects, in step 911, the next source note and repeats steps 904 to 911.

Figure 9:
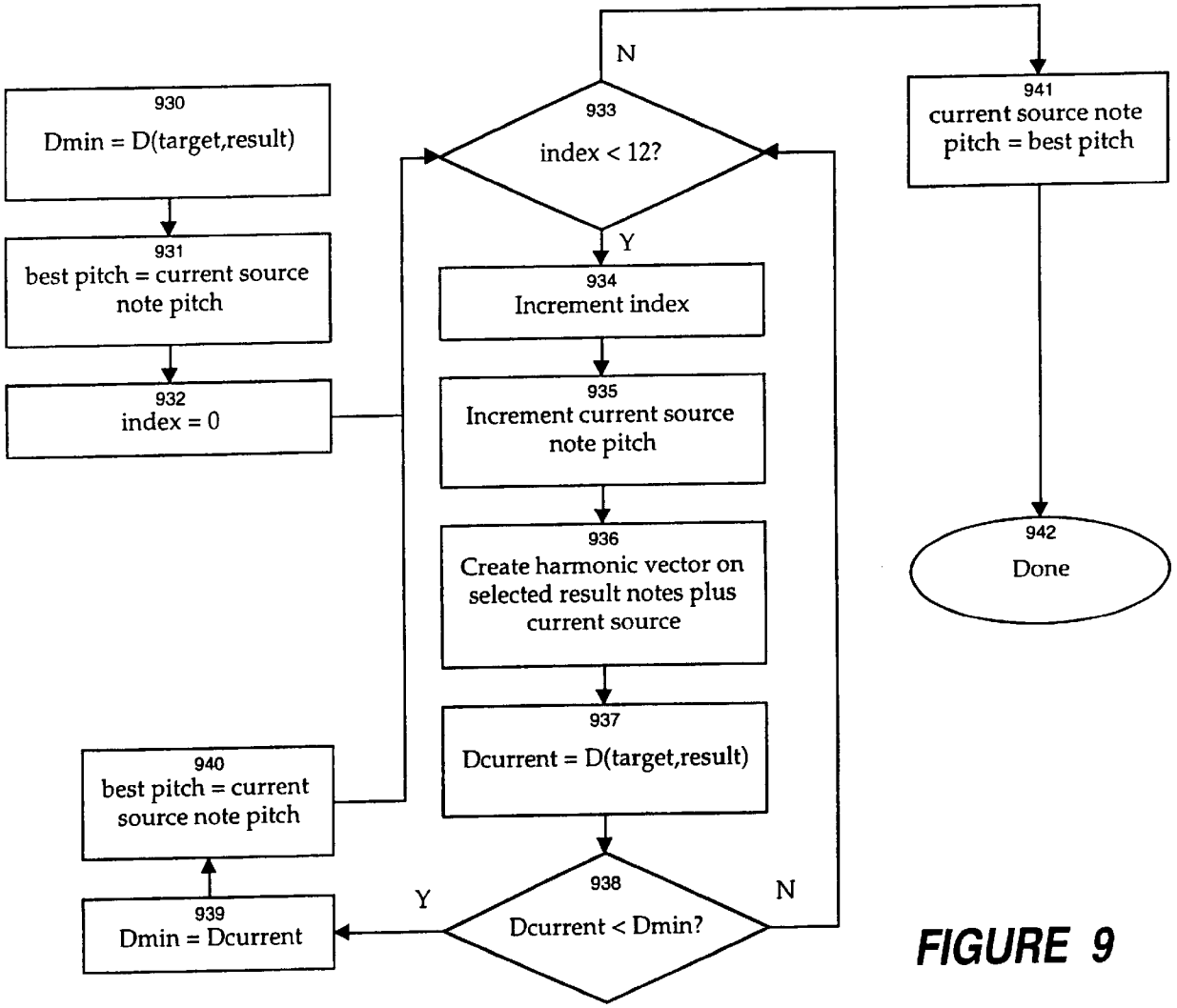
FIG. 9 is a flowchart depicting a method of selecting a best pitch according to the present invention.

Referring now to FIG. 9, there is shown a flowchart depicting a method of selecting a best pitch, as used in step 908 of FIG. 8. In the method of FIG. 9, system 100 tries all 12 possible transpositions of the pitch to determine which transposition yields the "best" pitch, based on minimum angle between vectors. For each transposition, the harmonic attractor takes a measure of the harmonic distance between the source note, combined with the output notes at that point, and the target notes at the corresponding time. The harmonic attractor looks for the transposition which results in the smallest distance between source and target. In the case of a tie, it selects the smaller transposition.

In step 930, system 100 sets Dmin to be equal to the angle between the target and the result harmonic vectors. In step 931, system 100 sets best pitch to be equal to the pitch of the current source note pitch. In step 932, system 100 sets index to be zero.

In step 933, system 100 determines whether index is less than 12. If so, system 100, in step 934 increments index and in step 935 increments the pitch of the current note pitch. In step 936, a harmonic vector is created based on the selected result notes plus the current source note, using the current source note pitch. In step 937, a current angle is determined, based on the angle between the target and the result. In step 938, if this current angle is less than Dmin, system 100, in steps 939 and 940, sets Dmin to be equal to the current angle, and sets the best pitch to the current source note pitch.

By cycling through steps 933 to 940 for each index until all 12 pitches have been tried, system 100 determines the best pitch for the source note. In step 941, it assigns this best pitch to the current source note pitch.

Harmonic Vector

The harmonic vector is a representation of harmonic data embodied by any arbitrary list of notes. It is way of breaking down the harmony of a musical passage into a multidimensional vector. The purpose of this is to be able to take empirical measurements of harmonic relatedness or proximity, between any two collections of notes.

The harmonic vector can be thought of as a vector sum of one or more pitch class (PC) vectors. A PC vector is a representation of a single note, as will be described in more detail below. Referring now to FIG. 10*a,* there is shown a graphic depiction of four consecutive harmonic vectors 1021, 1022, 1023, 1024 created for four consecutive positions 1031, 1032, 1033, 1034 in a musical fragment 1035. For each vector, there is shown a list of the component vectors, the harmonic vector which represents a sum of the component vectors, and a normalized harmonic vector.

Figure 10:
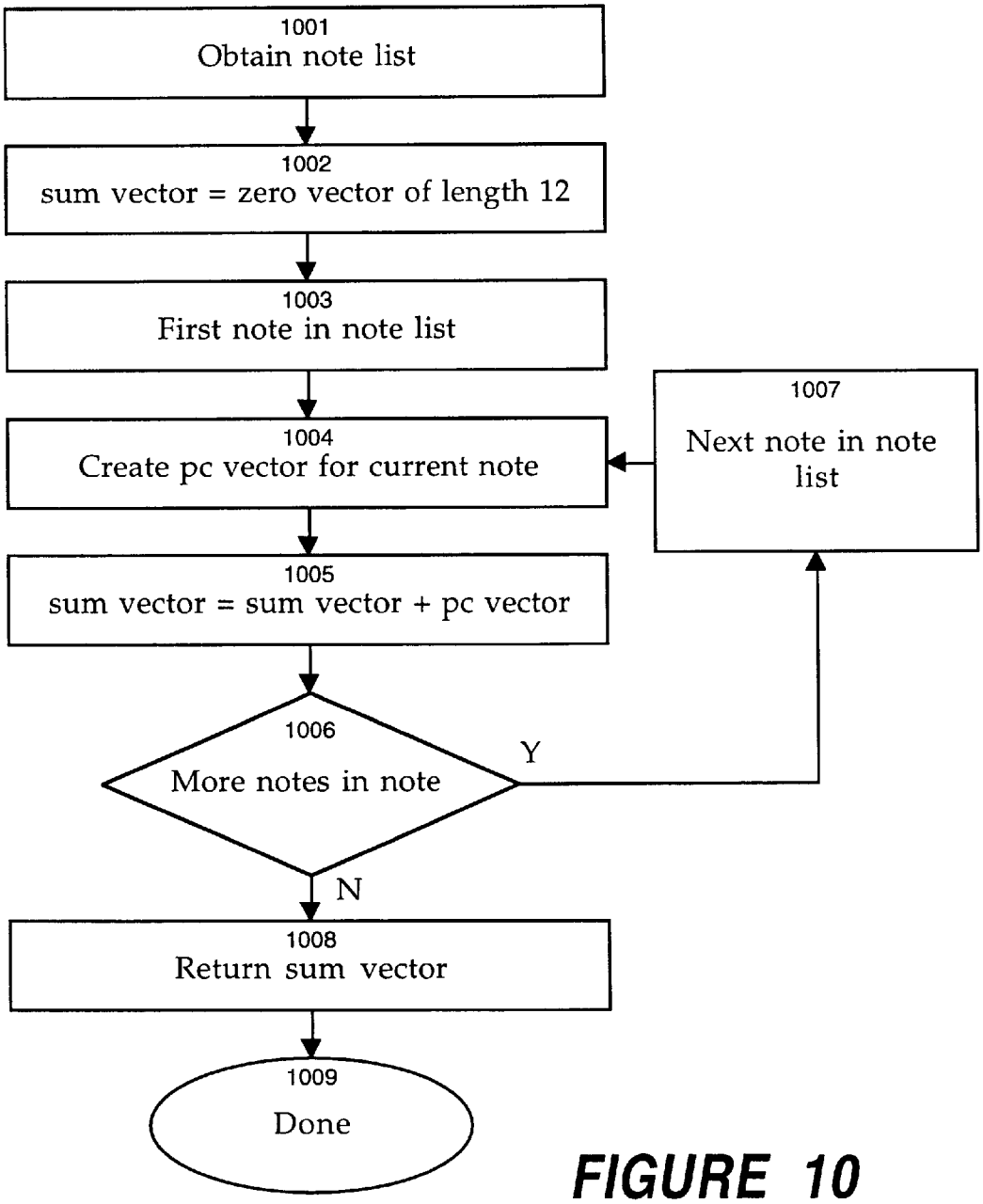
FIG. 10 is a flowchart depicting the element of the present invention that creates an harmonic vector.
Figure 10A:
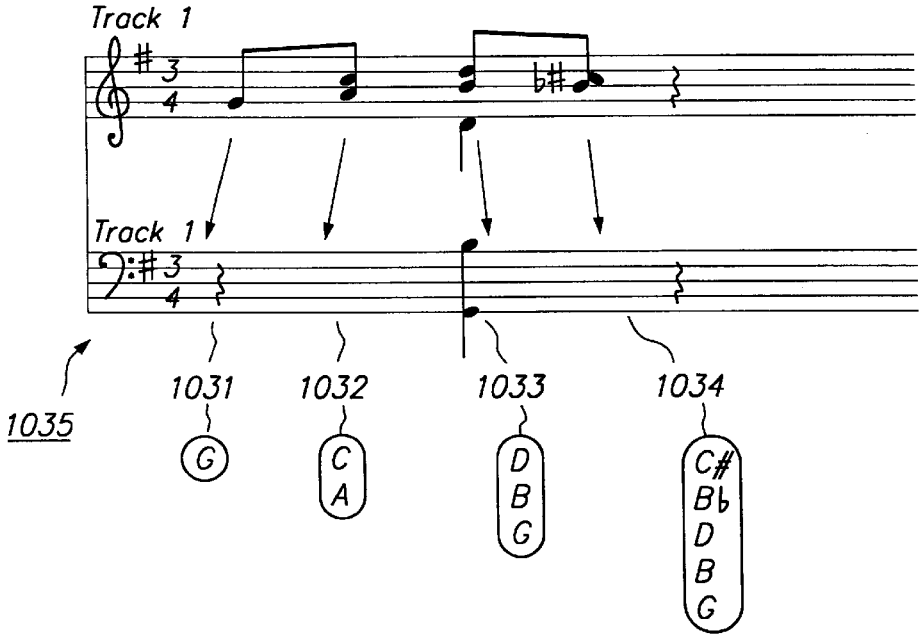
FIG. 10*a* depicts a graphic representation of four consecutive harmonic vectors created for four consecutive positions in a musical fragment.

Referring now to FIG. 10, there is shown a flowchart depicting a method of creating a harmonic vector according to the present invention. In step 1001, system 100 obtains a list of notes to be represented. System 100 initializes, in step 1002, a sum vector to be a zero vector of length 12: a 12-dimensional vector filled with the number 0. Each position in the vector is able to hold a value.

In step 1003, system begins with the first note in the note list, and, in step 1004, creates a PC vector for the current note, as will be described in more detail below. The PC vector is a representation of the note that embodies its harmonic characteristics.

In step 1005, sum vector is added to PC vector, using vector addition, to generate a new sum vector. Thus, the value in each position of the PC vector is added to the value of its corresponding position in the sum vector. In step 1006, if more notes exist in the note list, system 100 proceeds to step 1007 to go to the next note and repeat steps 1004 to 1006. Once all notes in the note list have been processed, system 100, in step 1008, returns the sum vector.

PC Vector

The PC vector is a representation of the pitch of a note. It is a 12-bit vector, designed to interact with other PC vectors in a musically meaningful way. Referring again to FIG. 10*a,* there are shown PC vectors for the various notes found in each position 1031, 1032, 1033, 1034 of the musical fragment. For example, the PC vector for the first note, G, is given as:

(1 1 1 1 1 0 0 0 0 0 1 1)

PC vectors provide musically meaningful representations of notes in the following manner. Pitches in MIDI-based systems are represented as ascending integers from 0 to 127 where 0 represents the C five octaves below middle C, and 127 represents the G five and a half octaves above middle C. Each octave contains twelve pitches (C, C#, D, D#, E, F, F#, G#, A, A#, B), which may also be represented in terms of flats instead of sharps. A pitch class (PC) represents the position of a pitch within the octave: the pitch number modulo 12.

Intervals among the twelve pitches are defined as follows:

| # of semi-tones | Interval Code | Interval Name |
|---|---|---|
| 1 | m2 | Minor Second |
| 2 | M2 | Major Second |
| 3 | m3 | Minor Third |
| 4 | M3 | Major Third |
| 5 | P4 | Major Fourth |
| 6 | a4/d5 | Augmented Fourth / Diminished Fifth |
| 7 | P5 | Perfect Fifth |
| 8 | m6 | Minor Sixth |
| 9 | M6 | Major Sixth |
| 10 | m7 | Minor Seventh |
| 11 | M7 | Major Seventh |

The circle-of-fifths is an ordering of PC's produced by applying the following equation:

$$PC_{n+1}=(PC_n+7) \bmod 12 \qquad \text{(Eq. 4)}$$

Thus, to obtain the next PC in the circle-of-fifths, one adds seven to the current PC, and performs modulo 12 on the result. Seven semitones span a perfect fifth (P5), which is a fundamental musical interval. After twelve applications of Eq. 4, the circle-of-fifths returns to its starting point.

If Eq. 4 is repeatedly applied, starting with a PC of zero, one obtains the series with the following initial 12 terms:

0, 7, 2, 9, 4, 11, 6, 1, 8, 3, 10, 5

Given that PC=0 represents C, the series represents the following notes, in order:

C, G, D, A, E, B, F#, C#, G#, D#, A#, F

Again, the sharps could equivalently be represented as flats

Pitches that are in close proximity within the series defined by the circle of fifths are more harmonically stable than pitches which are more distantly related. Adjacent pitches, which by definition are related by a perfect fifth, are the most stable and form the most musically pleasing relationship.

Most music is locally structured to emphasize a diatonic subset of the twelve PC's available. This subset can most easily be derived by choosing any adjacent seven PC's within the circle of fifths. For example, a diatonic subset may include the following notes:

C, G, D, A, E, B, F#

The interval formed by the first and last PC's of a diatonic semi-circle-of fifths is d5, defined as two PC's six semitones apart. In the above example, C and F# form the d5 interval. The d5 interval divides the octave in two equal halves and is also the closest possible interval to P5 which cannot be inverted to produce a smaller interval (because it is its own inverse). The closeness in interval size between P5 and d5 (seven semitones and six semitones, respectively) generates a natural partitioning of the intervals within the diatonic set into: P4/d5 (one leap around the semi-circle-of-fifths), M2/m2 (two leaps around the semi-circle-of-fifths), and m3/M3 (three leaps around the semicircle-of-fifths). Leaps greater than three and intervals greater than d5 are simply inversions of these leaps and intervals. The partitioning occurs because a compound leap which includes d5 will be one semitone smaller in size than a compound leap composed entirely of PC's. This partitioning allows P5 to measure harmonic distance within the diatonic set while preserving relative interval sizes.

Examples of the numerical basis for associating major and minor intervals can be seen by taking the circle-of-fifths, repeated twice:

0, 7, 2, 9, 4, 11, 6, 1, 8, 3, 10, 5, 0, 7, 2, 9, 4, 11, 6, 1, 8, 3, 10, 5 and a diatonic semicircle-of-fifths, repeated three times:

0, 7, 2, 9, 4, 11, 6, 0, 7, 2, 9, 4, 11, 6, 0, 7, 2, 9, 4, 11, 6.

Taking every second term of the circle-of-fifths yields a sequence of major seconds (M2):

0, 2, 4, 6, 8, 10, 0, 2, 4, 6, . . .

Taking every second term of the diatonic semicircle-of-fifths yields a mixture of major seconds and minor seconds (M2/m2):
0, 2, 4, 6, 7, 9, 11, 0, 2, 4, . . .

Taking every third term of the circle-of-fifths yields a sequence of minor thirds (m3):

0, 9, 6, 3, 0, 9, 6, 3, . . .

Taking every third term of the diatonic semicircle-of-fifths yields a mixture of major and minor thirds (M3/m3):

0, 9, 6, 2, 11, 7, 4, 0, 9, 6, . . .

The PC vector uses a twelve-dimensional vector to represent a single PC. Collections of PC's (chords, for instance) are represented as the vector sum of the vectors representing the PC's in that collection. The twelve dimensions in the vector represent the twelve notes in the octave and are ordered based on the circle-of-fifths. For a given PC, each element of the vector is calculated by determining how closely the PC is to the harmonic center of the diatonic set represented by that vector element. Thus, each PC vector contains seven adjacent non-zero elements, possibly with larger values occurring in the elements toward the middle. In one embodiment, non-zero elements are given a value of 1, and the resultant vector is scaled by weighting factors, to obtain other non-zero values. This representation captures the fact that a PC can play a role in seven different diatonic sets. No two PC vectors are completely orthogonal, since at least one diatonic set can be found to contain any combination of two PC's.

For example, the PC vector for the note A (corresponding to a PC of 3) might be given as:

(1 1 1 1 1 1 1 0 0 0 0 0)

so that the seven vector positions closest to that of index 3, i.e. positions 0 through 6, are filled with non-zero values. Similarly, the PC vector for the note G (corresponding to a PC of 1) might be given as:

(1 1 1 1 1 0 0 0 0 0 1 1)

so that positions 0 through 4 and 10 through 11 are filled with non-zero values.

Figure 11:
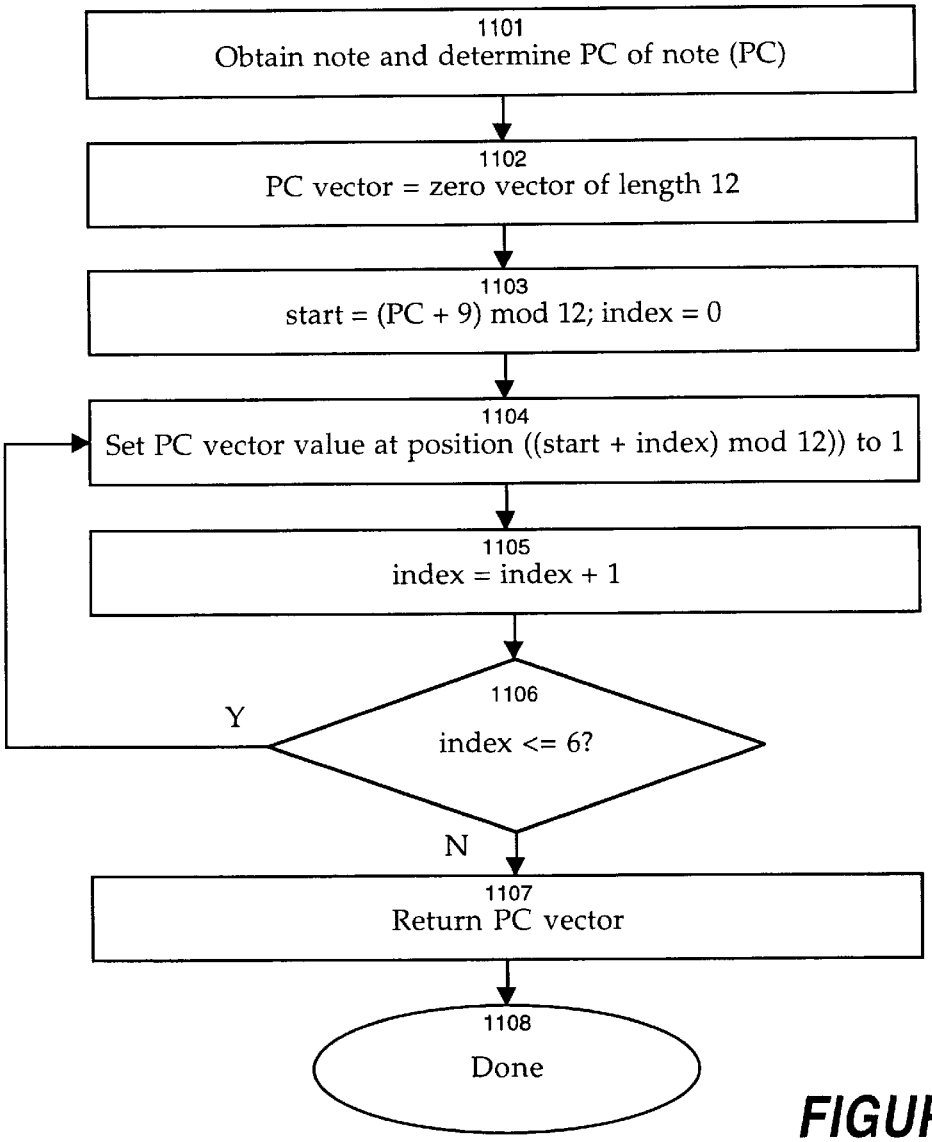
FIG. 11 is a flowchart depicting the element of the present invention that creates a PC vector.

Referring now to FIG. 11, there is shown a flowchart depicting a method of generating a PC vector, given any note. System 100, in step 1101, obtains a note and determines its PC by applying the formula PC=(pitch mod 12), as described above. In step 1102, system 100 initializes the PC vector to a 12-dimensional zero vector. A start point is initialized, in step 1103, to a value of (PC+9) mod 12, which will place it three semitones below the pitch of the note, and an index is initialized to 0. In steps 1104 through 1106, system 100 steps through the vector, beginning at the start point and setting values to 1 at seven consecutive positions in the vector. If the end of the vector is reached, the mod operation in 1104 cycles the index point back to the beginning. In step 1107, system 100 returns the resultant PC vector.

Thus, the method of FIG. 11 serve to place 1's at the 7 slots of the output vector which are centered around the starting position.

Groove System

A groove filter is a type of assembler which takes a multi-instrument target zone and breaks it into elements representing each instrument part. The groove analogy then uses sharks to find substitutes for each of the elements. Sharks are elements which find pairs of excerpts in the database which are close enough in role and rhythmic structure to be good candidates to substitute for each other in certain settings. Combining the substitute with the work-in-progress results in a new multi-instrument passage.

The groove filter operates as follows. As a first pass at reducing tonal clashes, each zone to be searched by the sharks for substitute parts is first transposed to the same key as the target. A harmonic attractor node can be run on the results of a groove analogy to make the harmony of the results more like that of the target. All of these elements are described above in more detail.

Groove assemblers are assemblers which take a list of desired roles to be filled in a multi-instrument passage. Virtual zones are used to identify potential zones to play each role. For instance a groove assembler could be used to find an arbitrary combination of snare, kick drum, and base parts. Different combinations can be tried until acceptable output is produced.

Groove assemblers might often be used to add parts to an agenda previously configured by a groove analogy.

Groove attractors are assemblers which take the audible nodes of an agenda and cause the rhythms of each audible node to become more like the rhythms of the corresponding instrument parts of a multi-instrumental target zone.

Figure 12:
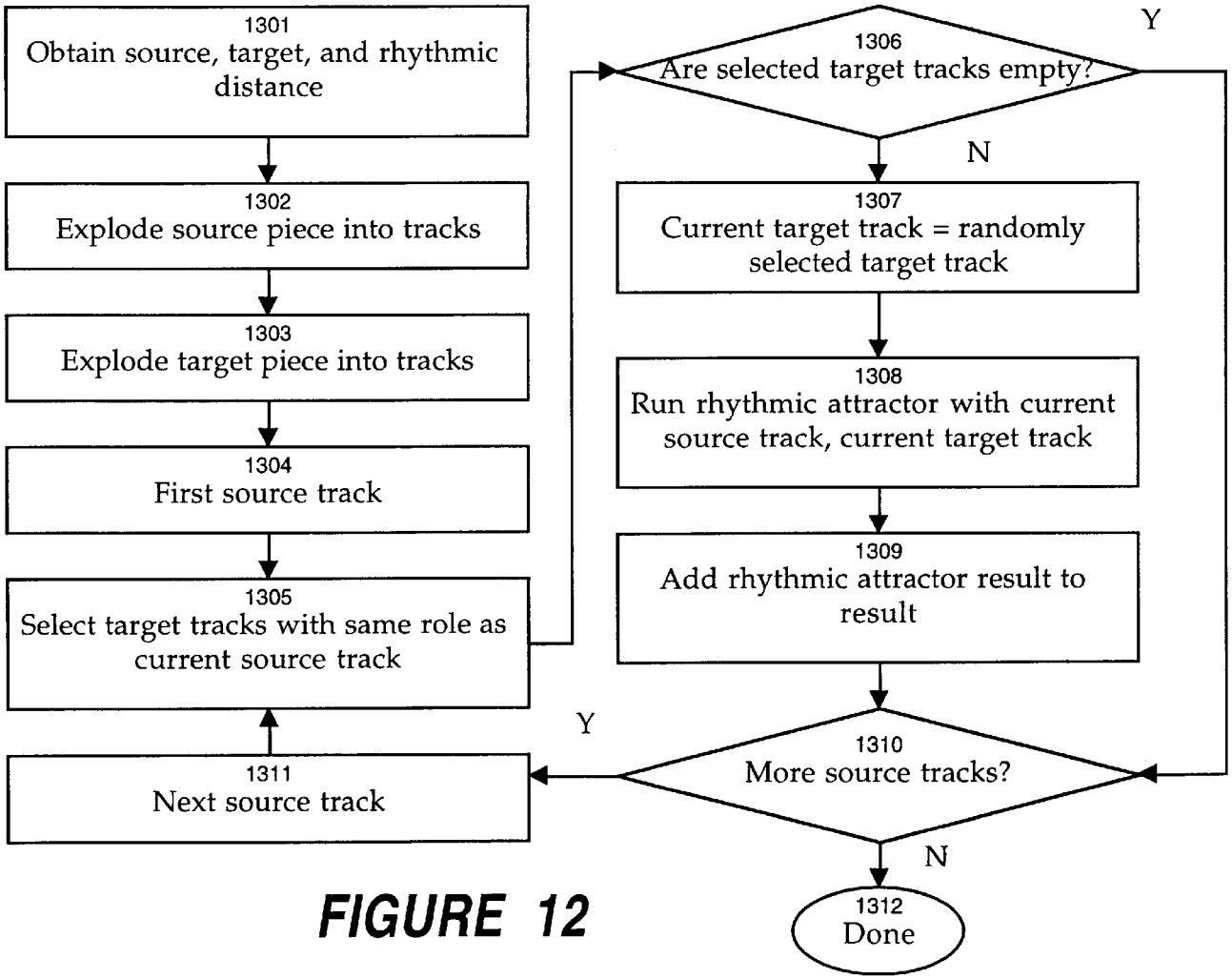
FIG. 12 is a flowchart depicting the functional operation of the groove attractor element of the present invention.

Referring now to FIG. 12, there is shown a flowchart of a method of operation of a groove attractor 126 according to the present invention. According to this method, one set of musical parts (the source) is mapped onto another set (the target). A rhythmic attractor 127 is used to draw the source closer to the target in rhythmic terms.

In step 1301, system 100 obtains a source piece, target piece, and a rhythmic distance specifying how closely the two pieces should match. In steps 1302 and 1303, system

100 explodes the source and target pieces into tracks, thus dividing the pieces into their component parts. In step 1304, system 100 selects the first source track. In step 1305, system 100 selects target tracks having the same role as the current track, and in step 1306 it determines if the selected target tracks are empty. If not, system in steps; 1307 through 1309 sets the current target track to a randomly selected target track, runs the rhythmic attractor method as described above in connection with FIG. 3, using the current source and target tracks, and adds the result to a cumulative result. If in step 1306 the selected target tracks are empty, system 100 skips steps 1307 through 1309.

If in step 1310 there are more source tracks, system 100 selects, in step 1311 the next source track and repeats steps 1305 through 1310. Once all source tracks have been processed, system 100 can return the cumulative result that has been developed.

Groove Filter

The groove filter is an assembler which combines a series of musical fragments in such a way as to emulate some of the rhythmic character of the user's chosen target fragment. This target fragment is a piece of music which has a rhythmic character similar to the user's desired new composition. The user loads into the environment one or more precompiled libraries of musical fragments, in various styles, for use as target fragments by the groove filter. The user chooses a value for the rhythmic distance of the groove filter, a value which in one embodiment must be between 0 and 1. The closer this value is to 0, the more nearly the output of the groove filter will resemble the chosen target.

Figure 13:
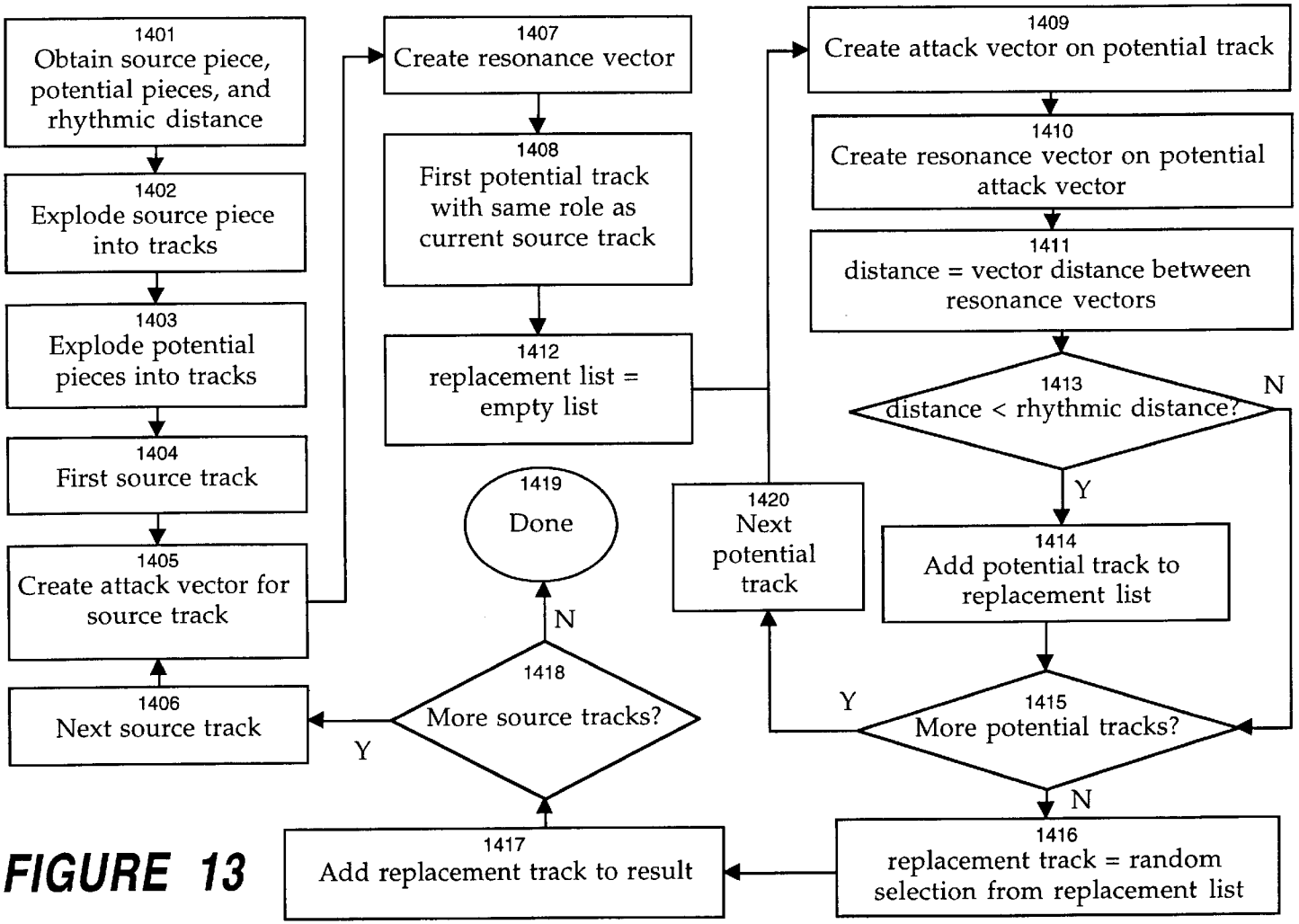
FIG. 13 is a flowchart depicting the functional operation of the groove filter element of the present invention.

Referring now to FIG. 13, there is shown a flowchart depicting a method for the groove filter according to the present invention.

In step 1401, system 100 obtains a source piece, potential pieces, and a specified rhythmic distance. Potential pieces are musical selections the user has loaded into the environment prior to running the groove filter. These are chosen from pre-compiled libraries of useful selections. In step 1402, system 100 explodes the source piece by breaking the source piece into coherent individual tracks (i.e., bass line, hi hats, and the like), by well-known methods. In step 1403, each potential piece is similarly exploded into its component parts.

In step 1404, system 100 selects the first source track to be processed. In step 1405, system 100 creates an attack vector, as described above. In step 1407, system 100 creates a resonance vector, as described above. System 100 then locates all of the potential fragments with a role that matches the role of the current exploded source track. For example, if the current source track has a role of snare, then the potential fragments for this source track are all those tracks in the environment which also have a role of snare.

A first potential track is selected for processing in step 1408, and a replacement list is initialized as empty in step 1412. In steps 1409 and 1410, system 100 creates an attack vector and resonance vector for the potential track. Then, in step 1411, system 100 finds the vector distance between the source resonance vector and the potential resonance vector, as described above. In steps 1413 and 1414, if that distance is less than the user-specified rhythmic distance, then the current potential track is added to the list of possible replacements.

If in step 1415, more potential tracks exist, system 100 selects another potential track in step 1420, and returns to step 1409. Once all of the potential tracks have been tested, a list of replacement tracks has been created. This is a list of musical fragments which have been measured and found to be within the user-specified distance to a track of the same role in the user's specified source fragment. Now a fragment may be selected from this list. In one embodiment such selection is made randomly, as shown in step 1416. The replacement selection is added to the result track in step 1417 If, in step 1418, more source tracks exist, system 100 selects another source track in step 1406, and returns to step 1405. Once all source tracks have been processed, the result is returned.

The present invention provides an apparatus and method for creating original works of music are provided. One skilled in the art will appreciate that the present invention can be practiced by other than the embodiments described above, which are presented for the presented for the purpose of illustration and not of limitation. The present invention is therefore limited only by the claims that follow.

What is claimed is:

1. A computer-implemented system for creating an original musical work, comprising:

a storage device for storing a plurality of source musical selections;

at least one modification module, coupled to the storage device, for modifying the source musical selections;

a user input device, coupled to the storage device and to the modification module, for receiving user input selecting at least one of the source musical selections and for receiving user input selecting at least one modification module for application to the selected at least one source musical selection; and an output device, coupled to the modification module, for outputting the modified at least one selection;

wherein the at least one modification module comprises at least one selected from the group consisting of:

an attractor module for modifying a selected characteristic of a source musical selection to increase similarity of the selected characteristic with respect to a target selection; and a filter for identifying component parts in a selection and electing substitutes for selected component parts;

and wherein the source musical selection comprises at least one audible node corresponding to an instrument part, and wherein the attractor module comprises a groove attractor for modifying at least one rhythm of at least one audible node of the source musical selection to increase similarity of the audible node with respect to at least one rhythm of the corresponding instrument part of a target musical selection.

2. The system of claim 1, further comprising a rhythmic attractor, coupled to the groove attractor, for modifying a rhythmic characteristic of the at least one audible node to increase similarity of the rhythmic characteristic with respect to a target musical selection.

3. A computer-implemented system for creating an original musical work, comprising:

a storage device for storing a plurality of source musical selections;

at least one modification module, coupled to the storage device, for modifying the source musical selections;

a user input device, coupled to the storage device and to the modification module, for receiving user input selecting at least one of the source musical selections and for receiving user input selecting at least one modification module for application to the selected at least one source musical selection; and an output device, coupled to the modification module, for outputting the modified at least one selection;

wherein the at least one modification module comprises at least one selected from the group consisting of:

an attractor module for modifying a selected characteristic of a source musical selection to increase similarity of the selected characteristic with respect to a target selection; and a groove filter for identifying component parts in a selection and selecting substitutes for selected component parts.

4. A computer-implemented method for creating an original musical work, comprising:

a) receiving a selection of at least one source musical selection stored on a storage device, the musical selection comprising at least one audible node corresponding to an instrument part;

b) receiving a selection of a groove attractor for modifying at least one rhythm of at least one audible node of the musical selection to increase similarity of the audible node with respect to at least one rhythm of the corresponding instrument part of a target musical selection;

c) retrieving the at least one selected source musical selection;

d) applying the groove attractor to the at least one selected source musical selection, to generate at least one modified musical selection; and e) outputting the at least one modified musical selection.

5. A computer-implemented method for creating an original musical work, comprising:

a) receiving a selection of at least one source musical selection stored on a storage device, the musical selection comprising at least one audible node corresponding to an instrument part;

b) receiving a selection of at least one modification module for application to the at least one selected source musical selection, the at least one modification module being selected from the group consisting of:

an attractor for modifying a selected characteristic of a source musical selection to increase similarity of the characteristic with respect to a target selection; and a filter for identifying component parts in a musical selection and selecting substitutes for selected component parts;

c) receiving a selection of a rhythmic attractor, for modifying a rhythmic characteristic of the at least one audible node to increase similarity of the rhythmic characteristic with respect to a target musical selection;

d) retrieving the at least one selected source musical selection;

e) applying the at least one modification module to the at least one selected source musical selection;

f) applying the rhythmic attractor to the at least one audible node of the at least one selected musical selection, to generate at least one modified musical selection; and g) outputting the at least one modified musical selection.

6. A computer-implemented method for creating an original musical work, comprising:

a) receiving a selection of at least one source musical selection stored on a storage device;

b) receiving a selection of a groove filter for identifying component parts in a musical selection and selecting at least one substitute for at least one selected component part;

c) retrieving the at least one selected source musical selection;

d) applying the groove filter to the at least one selected source musical selection, to generate at least one modified musical selection; and e) outputting the at least one modified musical selection.

7. A computer-implemented method of modifying a rhythmic characteristic of a source musical selection to increase similarity of the rhythmic characteristic with respect to a target musical selection, each musical selection comprising a plurality of notes having attack times, the method comprising:

a) creating a source attack vector representing the attack times of at least a subset of the notes of the source musical selection;

b) determining a source resonance vector from the source attack vector, the source resonance vector having a plurality of positions containing bits having values;

c) creating a target attack vector representing attack times of at least a subset of the notes of the target musical selection;

d) determining a target resonance vector from the target attack vector, the target resonance vector having a plurality of positions containing bits having values;

e) determining an initial distance metric between the source resonance vector and the target resonance vector; and f) responsive to the initial distance metric being greater than a predetermined distance metric, performing the steps of:

f.1) for each position in the source attack vector:

f.1.1) toggling the bit at the position;

f.1.2) creating a modified source attack vector;

f.1.3) determining a modified source resonance vector from the new source attack vector;

f.1.4) determining a modified distance metric between the new source resonance vector and the target resonance vector; and f.1.5) responsive to the modified distance metric being greater than or equal to the initial distance metric, restoring the toggled bit to its original value; and f.2) modifying the attack times of the notes of the source musical selection responsive to the modified source attack vector.

8. The computer-implemented method of claim 7, wherein f.2) comprises:

f.2) for each position in the source attack vector having a bit with a non-zero value:

f.2.1) determining the time position of the bit; and f.2.2) responsive to at least one note of the source selection having temporal and harmonic relatedness to the time position of the bit exceeding a predetermined threshold:

f.2.2.1) selecting at least one note of the source selection, responsive to temporal and harmonic relatedness to the time position of the bit; and f.2.2.2) setting the attack times of the selected at least one note to equal the time position of the bit.

9. The computer-implemented method of claim 7, wherein a) and c) each comprise:

1) initializing an attack vector having a plurality of positions containing bits having values; and 2) for each of a plurality of notes, each note having an attack time:

2.1) determining a position in the attack vector corresponding to the attack time of the note; and 2.2) setting a bit at the determined position in the attack vector.

10. The computer-implemented method of claim 7, wherein the source attack vector and the target attack vector each have a plurality of positions containing bits having values, and wherein b) and d) each comprise:

1) initializing a resonance vector having a plurality of positions containing bits having values; and 2) for each position in an attack vector containing a bit having a non-zero value:

2.1) creating a resonance measure of the position relative to other positions containing bits having non-zero values; and 2.2) storing the resonance measure in the position in the resonance vector corresponding to the position in the attack vector.

11. The computer-implemented method of claim 10, wherein 2.1) comprises:

2.1.1) determining an attack value responsive to the current position of the attack vector and a beat strength;

2.1.2) initializing a first resonance value for the resonance vector position to zero;

2.1.3) initializing an index to zero;

2.1.4) for each position in the attack vector containing a bit having a non-zero value:

2.1.4.1) determining a second resonance value between a note corresponding to the attack vector position and the determined attack value; and 2.1.4.2) incrementing the first resonance value by the second resonance value; and 2.1.5) providing the first resonance value as the resonance measure for 2.1).

12. The computer-implemented method of claim 11, wherein 2.1.4.1) comprises:

determining a rhythm length and a beat division;

determining a first depth value responsive to a binomial measure corresponding to the product of the attack vector position and the beat division;

determining a second depth value responsive to a binomial measure corresponding to the product of the determined attack value and the beat division; and determining a resonance value from the first and second depth values.

13. The computer-implemented method of claim 12, wherein determining the resonance value comprises determining a value of $$R = 1 - \frac{|\text{depth1} - \text{depth2}|}{(\log_2(\text{rhythemlength}*\text{beatdivision}))};$$

wherein depth1 is the first depth value and depth2 is the second depth value.

14. The computer-implemented method of claim 7, wherein:

e) comprises determining an initial distance metric using a Euclidean distance measure between the source resonance vector and the target resonance vector; and f.1.4) comprises determining a modified distance metric using a Euclidean distance measure between the source resonance vector and the target resonance vector.

15. A computer-implemented method of modifying a harmonic characteristic of a source musical selection to increase similarity of the harmonic characteristic with respect to a target musical selection, each musical selection comprising a plurality of notes, each note having a pitch value and an attack value, the method comprising:

a) initializing an accumulating output;

b) sorting the notes of the source musical selection responsive to pitch and attack values;

c) for each note in the source musical selection:

c.1) determining a subset of notes in the target musical selection having an attack value substantially identical to the attack value of the note in the source musical selection;

c.2) creating a first harmonic vector for the determined subset of notes in the target musical selection;

c.3) determining a pitch for a note in the source musical selection having a minimum vector distance from the first harmonic vector;

c.4) transposing the note in the source musical selection to the determined pitch; and c.5) adding the transposed note to the accumulating output.

16. The computer-implemented method of claim 15, further comprising, after c.2):

c.2.1) responsive to the accumulating output containing notes having an attack value substantially identical to the attack value of the note in the source musical selection, selecting the notes in the accumulating output having attack values substantially identical to the attack value of the note in the source musical selection; and c.2.2) creating a second harmonic vector for the notes selected in c.3);

and wherein c.3) comprises determining a pitch for the note in the source musical selection having minimum vector distance from the first harmonic vector and responsive to the second harmonic vector.

17. A computer-implemented method of modifying a rhythmic characteristic of a track of a source musical selection to increase similarity of the rhythmic characteristic with respect to a corresponding track of a target musical selection, the method comprising:

a) receiving a source musical selection, a target musical selection, and a rhythmic distance;

b) exploding the source musical selection into at least one source track, each source track having a role;

c) exploding the target musical selection into at least one target track, each target track having a role;

d) for at least one source track:

d.1) identifying a subset of the at least one target track having a role substantially similar to the role of the source track;

d.2) responsive to the identified subset not being empty, selecting a target track from the identified subset;

d.3) invoking a rhythmic attractor on the source track and the selected target track, to increase similarity of a rhythmic characteristic of the source track with respect tc the selected target track; and d.4) adding the result of d.3) to a cumulative result; and e) outputting the cumulative result.

18. A computer-implemented method of combining musical selections to emulate rhythmic character of another musical selection, comprising:

a) receiving a source musical selection, at least one potential musical selection, and a rhythmic distance metric;

b) exploding the source musical selection into at least one source track, each source track having a role;

c) exploding each at least one potential musical selection into at least one potential track, each potential track having a role;

d) for at least one source track;

d.1) creating an attack vector for the source track;

d.2) creating a resonance vector for the source track;

d.3) identifying a subset of the at least one potential track having a role substantially similar to the role of the source track;

d.4) for each potential track in the subset:

d.4.1) initializing a replacement list;

d.4.2) creating an attack vector for the potential track;

d.4.3) creating a resonance vector for the potential track;

d.4.4) determining a vector distance between the source resonance vector and the potential resonance vector; and d.4.5) responsive to the determined vector distance being less than the received rhythmic distance metric, adding the potential track to the replacement list;

d.5) selecting a potential track from the replacement list; and d.6) outputting the selected potential track.

19. A computer program product comprising a computer-usable medium having computer-readable code embodied therein for creating an original musical work, the computer program product comprising:

a) computer-readable program code devices configured to cause a computer to receive a selection of at least one source musical selection stored on a storage device the musical selection comprising at least one audible node corresponding to an instrument part;

b) computer-readable program code devices configured to cause a computer to receive a selection of a groove attractor for modifying at least one rhythm of at least one audible node of the musical selection to increase similarity of the audible node with respect to at least one rhythm of the corresponding instrument part of a target musical selection; and c) computer-readable program code devices configured to cause a computer to retrieve the at least one selected source musical selection;

d) comprises computer-readable program code devices configured to cause a computer to apply the groove attractor to the at least one selected source musical selection to generate at least one modified musical selection; and e) computer-readable program code devices configured to cause a computer to output the at least one modified musical selection.

20. A computer program product comprising a computer-usable medium having computer-readable code embodied therein for creating an original musical work, the computer program product comprising:

a) computer-readable program code devices configured to cause a computer to receive a selection of at least one source musical selection stored on a storage device;

b) computer-readable program code devices configured to cause a computer to receive a selection of at least one modification module for application to the at least one selected source musical selection, the at least one modification module being selected from the group consisting of:

an attractor for modifying a selected characteristic of a source musical selection to increase similarity of the characteristic with respect to a target musical selection; and a filter for identifying component parts in a musical selection and selecting substitutes for selected component parts;

c) computer-readable program code devices configured to cause a computer to receive a selection of a rhythmic attractor, for modifying a rhythmic characteristic of the at least one audible node to increase similarity of the rhythmic characteristic with respect to a target musical selection;

d) computer-readable program code devices configured to cause a computer to retrieve the at least one selected source musical selection;

e) computer-readable program code devices configured to cause a computer to apply the at least one modification module to the at least one selected source musical selection;

d) computer-readable program code devices configured to cause a computer to apply the rhythmic attractor to the at least one audible node of the at least one selected musical selection, to generate at least one modified musical selection; and e) computer-readable program code devices configured to cause a computer to output the at least one modified musical selection.

21. A computer program product comprising a computer-usable medium having computer-readable code embodied therein for creating an original musical work, the computer program product comprising:

a) computer-readable program code devices configured to cause a computer to receive a selection of at least one source musical selection stored on a storage device;

b) computer-readable program code devices configured to cause a computer to receive a selection of a groove filter for identifying component parts in a musical selection and selecting at least one substitute for at least one selected component part;

c) computer-readable program code devices configured to cause a computer to retrieve the at least one selected source musical selection;

d) computer-readable program code devices configured to cause a computer to apply the groove filter to the at least one selected source musical selection, to generate at least one modified musical selection; and e) computer-readable program code devices configured to cause a computer to output the at least one modified musical selection.

22. A computer program product comprising a computer-usable medium having computer-readable code embodied therein for modifying a rhythmic characteristic of a source musical selection to increase similarity of the rhythmic characteristic with respect to a target musical selection, each musical selection comprising a plurality of notes having attack times, the computer program product comprising:

a) computer-readable program code devices configured to cause a computer to create a source attack vector representing the attack times of at least a subset of the notes of the source musical selection;

b) computer-readable program code devices configured to cause a computer to determine a source resonance vector from the source attack vector, the source resonance vector having a plurality of positions containing bits having values;

c) computer-readable program code devices configured to cause a computer to create a target attack vector representing attack times of at least a subset of the notes of the target musical selection;

d) computer-readable program code devices configured to cause a computer to determine a target resonance vector from the target attack vector, the target resonance vector having a plurality of positions containing bits having values;

e) computer-readable program code devices configured to cause a computer to determine an initial distance metric between the source resonance vector and the target resonance vector; and f) computer-readable program code devices configured to cause a computer to, responsive to the initial distance metric being greater than a predetermined distance metric:

f.1) for each position in the source attack vector:

f.1.1) toggle the bit at the position;

f.1.2) create a modified source attack vector;

f.1.3) determine a modified source resonance vector from the new source attack vector;

f.1.4) determine a modified distance metric between the new source resonance vector and the target resonance vector; and f.1.5) responsive to the modified distance metric being greater than or equal to the initial distance metric, restore the toggled bit to its original value; and f.2) modify the attack times of the notes of the source musical selection responsive to the modified source attack vector.

23. The computer program product of claim 22, wherein in f.2), the computer-readable program code devices are configured to cause a computer to:

f.2) for each position in the source attack vector having a bit with a non-zero value:

f.2.1) determine the time position of the bit; and f.2.2) responsive to at least one note of the source selection having temporal and harmonic relatedness to the time position of the bit exceeding a predetermined threshold:

f.2.2.1) select at least one note of the source selection, responsive to temporal and harmonic relatedness to the time position of the bit; and f.2.2.2) set the attack times of the selected at least one note to equal the time position of the bit.

24. The computer program product of claim 22, wherein a) and c) each comprise:

1) computer-readable program code devices configured to cause a computer to initialize an attack vector having a plurality of positions containing bits having values; and 2) computer-readable program code devices configured to cause a computer to, for each of a plurality of notes, each note having an attack time:

2.1) determine a position in the attack vector corresponding to the attack time of the note; and 2.2) set a bit at the determined position in the attack vector.

25. The computer program product of claim 22, wherein the source attack vector and the target attack vector each have a plurality of positions containing bits having values, and wherein b) and d) each comprise:

1) computer-readable program code devices configured to cause a computer to initialize a resonance vector having a plurality of positions containing bits having values; and 2) computer-readable program code devices configured to cause a computer to, for each position in an attack vector containing a bit having a non-zero value:

2.1) create a resonance measure of the position relative to other positions containing bits having non-zero values; and 2.2) store the resonance measure in the position in the resonance vector corresponding to the position in the attack vector.

26. The computer program product of claim 25, wherein in 2.1), the computer-readable program code devices are configured to cause a computer to:

2.1.1) determine an attack value responsive to the current position of the attack vector and a beat strength;

2.1.2) initialize a first resonance value for the resonance vector position to zero;

2.1.3) initialize an index to zero;

2.1.4) for each position in the attack vector containing a bit having a non-zero value:

2.1.4.1) determine a second resonance value between a note corresponding to the attack vector position and the determined attack value; and 2.1.4.2) increment the first resonance value by the second resonance value; and 2.1.5) provide the first resonance value as the resonance measure for 2.1).

27. The computer program product of claims 26, wherein in 2.1.4.1), the computer-readable program code devices are configured to cause a computer to:

determine a rhythm length and a beat division;

determine a first depth value responsive to a binomial measure corresponding to the product of the attack vector position and the beat division;

determine a second depth value responsive to a binomial measure corresponding to the product of the determined attack value and the beat division; and determine a resonance value from the first and second depth values.

28. The computer program product of claim 27, wherein, in determining the resonance value, the computer-readable program code devices are configured to cause a computer to determine a value of $$R = 1 - \frac{|\text{depth1} - \text{depth2}|}{(\log_2(\text{rhythemlength}*\text{beatdivision}))};$$

wherein depth1 is the first depth value and depth2 is the second depth value.

29. The computer program product of claim 22, wherein:

e) comprises computer-readable program code devices configured to cause a computer to determine an initial distance metric using a Euclidean distance measure between the source resonance vector and the target resonance vector; and f.1.4) computer-readable program code devices configured to cause a computer to determine a modified distance metric using a Euclidean distance measure between the source resonance vector and the target resonance vector.

30. A computer program product comprising a computer-usable medium having computer-readable code embodied therein to increase similarity of the harmonic characteristic with respect to a target musical selection, each musical selection comprising a plurality of notes, each note having a pitch value and an attack value, the computer program product comprising:

a) computer-readable program code devices configured to cause a computer to initialize an accumulating output;

b) computer-readable program code devices configured to cause a computer to sort the notes of the source musical selection responsive to pitch and attack values;

c) computer-readable program code devices configured to cause a computer to, for each note in the source musical selection:

c.1) determine a subset of notes in the target musical selection having an attack value substantially identical to the attack value of the note in the source musical selection;

c.2) create a first harmonic vector for the determined subset of notes in the target musical selection;

c.3) determine a pitch for a note in the source musical selection having a minimum vector distance from the first harmonic vector;

c.4) transpose the note in the source musical selection to the determined pitch; and c.5) add the transposed note to the accumulating output.

31. The computer program product of claim 30, further comprising:

c.2.1) computer-readable program code devices configured to cause a computer to, responsive to the accumulating output containing notes having an attack value substantially identical to the attack value of the note in the source musical selection, select the notes in the accumulating output having attack values substantially identical to the attack value of the note in the source musical selection; and c2.2) computer-readable program code devices configured to cause a computer to create a second harmonic vector for the notes selected in c.3);

and wherein in c.3), the computer-readable program code devices are configured to cause a computer to determine a pitch for the note in the source musical selection having minimum vector distance from the first harmonic vector and responsive to the second harmonic vector.

32. A computer program product comprising a computer-usable medium having computer-readable code embodied therein for modifying a rhythmic characteristic of a track of a source musical selection to increase similarity of the rhythmic characteristic with respect to a corresponding track of a target musical selection, the computer program product comprising:

a) computer-readable program code devices configured to cause a computer to receive a source musical selection, a target musical selection, and a rhythmic distance ;

b) computer-readable program code devices configured to cause a computer to explode the source musical selection into at least one source track, each source track having a role;

c) computer-readable program code devices configured to cause a computer to explode the target musical selection into at least one target track, each target track having a role;

d) computer-readable program code devices configured to cause a computer to, for at least one source track:

d.1) identify a subset of the at least one target track having a role substantially similar to the role of the source track;

d.2) responsive to the identified subset not being empty, select a target track from the identified subset;

d.3) invoke a rhythmic attractor on the source track and the selected target track, to increase similarity of a rhythmic characteristic of the source track with respect to the selected target track; and d.4) add the result of d.3) to a cumulative result; and e) computer-readable program code devices configured to cause a computer to output the cumulative result.

33. A computer program product comprising a computer-usable medium having computer-readable code embodied therein for combining musical selections to emulate rhythmic character of another musical selection, the computer program product comprising:

a ) computer-readable program code devices configured to cause a computer to receive a source musical selection, at least one potential musical selection, and a rhythmic distance metric;

b) computer-readable program code devices configured to cause a computer to explode the source musical selection into at least one source track, each source track having a role;

c) computer-readable program code devices configured to cause a computer to explode each a t least on e potential musical selection into at least one potential track, each potential track having a role;

d) computer-readable program code devices configured to cause a computer to, for at least one source track;

d.1) create an attack vector for the source track;

d.2) create a resonance vector for the source track;

d.3) identify a subs et of the at least one potential track having a role substantially similar to the role of the source track;

d.4) for each potential track in the subset:

d.4.1) initialize a replacement list;

d.4.2) create an attack vector for the potential track;

d.4.3) create a resonance vector for the potential track;

d.4.4) determine a vector distance between the source resonance vector and the potential resonance vector; and d.4.5) responsive to the determined vector distance being less than the received rhythmic distance metric, add the potential track to the replacement list;

d.5) select a potential track from the replacement list; and d.6) output the selected potential track.

* * * * *

UNITED STATES PATENT AND TRADEMARK OFFICE

CERTIFICATE OF CORRECTION

PATENT NO. : 6,051,770

DATED : April 18, 2000

INVENTOR(S) : Andy M. Milburn, Jay Hardesty and Joseph P. Lubin

It is certified that error appears in the above-identified patent and that said Letters Patent is hereby corrected as shown below:

In the Abstract, line 10, after "is" delete ",".

Column 26, line 57, replace "tc" with --to--.

Column 27, line 34, after "device" insert --,--.

Column 30, line 27, replace "claims" with --claim--.

Column 31, line 50, delete space between "distance" and ";".

Column 32, line 31, delete space between "a" and "t".

Column 32, line 31, delete space between "on" and "e".

Column 32, line 38, delete space between "subs" and "et".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*